US011196186B2

(12) United States Patent
Mathews et al.

(10) Patent No.: US 11,196,186 B2
(45) Date of Patent: Dec. 7, 2021

(54) COAXIAL CABLE BONDING/GROUNDING BLOCKS

(71) Applicant: PPC BROADBAND, INC., East Syracuse, NY (US)

(72) Inventors: Roger Mathews, Syracuse, NY (US); Brian K. Hanson, Cicero, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/903,290

(22) Filed: Jun. 16, 2020

(65) Prior Publication Data

US 2020/0313312 A1 Oct. 1, 2020

Related U.S. Application Data

(63) Continuation-in-part of application No. 16/412,176, filed on May 14, 2019, now Pat. No. 10,686,263, which is a continuation-in-part of application No. 15/824,926, filed on Nov. 28, 2017, now Pat. No. 10,290,956.

(60) Provisional application No. 62/426,651, filed on Nov. 28, 2016, provisional application No. 62/975,045, filed on Feb. 11, 2020, provisional application No. 62/975,053, filed on Feb. 11, 2020.

(51) Int. Cl.

| | |
|---|---|
| ***H01R 4/18*** | (2006.01) |
| ***H01R 4/36*** | (2006.01) |
| ***H01R 4/30*** | (2006.01) |
| ***H01R 31/06*** | (2006.01) |
| *H01R 11/12* | (2006.01) |

(52) U.S. Cl.

CPC ..... *H01R 4/18* (2013.01); *H01R 4/187* (2013.01); *H01R 4/302* (2013.01); *H01R 4/36* (2013.01); *H01R 31/06* (2013.01); *H01R 11/12* (2013.01)

(58) Field of Classification Search

CPC ..... H01R 14/18; H01R 14/187; H01R 4/302; H01R 4/306; H01R 31/06

USPC ..... 439/97

See application file for complete search history.

(56) References Cited

U.S. PATENT DOCUMENTS

| | | | | |
|---|---|---|---|---|
| 4,152,742 | A | 5/1979 | Kronfeld | |
| 4,552,998 | A * | 11/1985 | Ziegler | H01R 4/64 200/11 R |
| 5,433,627 | A * | 7/1995 | Guerra | H01R 9/0509 439/394 |
| 6,431,885 | B1 * | 8/2002 | Stroup | H01R 4/64 174/78 |
| 6,500,028 | B1 * | 12/2002 | Higuchi | H01R 12/7064 439/607.37 |
| 6,877,996 | B1 * | 4/2005 | Franks, Jr. | H01R 4/42 439/782 |
| D508,676 | S * | 8/2005 | Franks, Jr. | D13/133 |
| 6,976,884 | B1 * | 12/2005 | Lee | H01R 9/0521 439/546 |
| 7,041,903 | B2 * | 5/2006 | Odahara | F16C 1/105 174/135 |

(Continued)

*Primary Examiner* — Alexander Gilman

(74) *Attorney, Agent, or Firm* — MH2 Technology Law Group LLP

(57) ABSTRACT

A ground block may include a metal ground plate and a ground wire fixedly coupled with the metal ground plate. The ground wire is configured to be non-detachable from the ground block during normal use of the ground block. The ground block may be formed by soldering, brazing, or clamping the ground wire to the metal ground plate.

10 Claims, 18 Drawing Sheets

(56) References Cited

U.S. PATENT DOCUMENTS 7,059,875 B2 * 6/2006 Kunimoto ..... H01R 13/6588 439/108
7,267,575 B1 9/2007 Hwang
7,422,453 B2 9/2008 Malin
7,462,042 B2 * 12/2008 Chawgo ..... H01R 4/36 439/92
7,540,758 B2 6/2009 Ho
7,731,512 B1 * 6/2010 Montena ..... H01R 4/64 439/108
7,780,461 B1 8/2010 Vernica
7,909,623 B2 * 3/2011 Lee ..... H01R 4/66 439/97
8,092,129 B2 1/2012 Wiley et al.
8,100,704 B1 * 1/2012 Wei ..... H01R 9/0512 439/97
8,210,858 B2 * 7/2012 Lee ..... H01R 24/70 439/108
8,258,402 B2 9/2012 Hagi et al.
9,160,103 B2 10/2015 Lirette
9,196,978 B2 11/2015 Magno
9,496,659 B2 11/2016 McRae
9,647,350 B2 5/2017 Rushing
9,678,298 B2 * 6/2017 Kimbrell ..... G02B 6/4471
9,853,370 B2 12/2017 Martin et al.
9,910,078 B2 3/2018 Lawrence et al.
10,379,310 B2 * 8/2019 Aznag ..... G02B 6/4446
2006/0030181 A1 * 2/2006 Blake ..... H01R 24/542 439/95
2006/0094270 A1 * 5/2006 Engler ..... H01R 9/0509 439/108
2011/0076866 A1 * 3/2011 Powell ..... H05K 9/0018 439/98
2016/0087354 A1 * 3/2016 Hanson ..... H01R 9/0503 439/98
2018/0151963 A1 * 5/2018 Mathews ..... H01R 4/023
2019/0267728 A1 * 8/2019 Mathews ..... H01R 24/52

* cited by examiner

COAXIAL CABLE BONDING/GROUNDING BLOCKS

CROSS-REFERENCE TO RELATED APPLICATIONS

This is a Continuation-in-Part of application Ser. No. 16/412,176, filed on May 14, 2019, pending, which is a Continuation-in-Part of application Ser. No. 15/824,926, filed Nov. 28, 2017, now U.S. Pat. No. 10,290,956, which claims the benefit of U.S. Provisional Application No. 62/426,651, filed Nov. 28, 2016. This application also claims the benefit of U.S. Provisional Application No. 62/975,045 and U.S. Provisional Application No. 62/975,053, both filed on Feb. 11, 2020. The disclosure of the prior applications is hereby incorporated by reference herein in its entirety.

TECHNICAL FIELD

The present disclosure relates generally to the field of coaxial cables and their use, and more particularly to a bonding/ground block used to provide an electrical ground for a coaxial cable.

BACKGROUND

In conventional cable television (CATV) systems, the outer conductor of a coaxial cable is electrically bonded to earth ground, i.e., grounded, at every end-user's home. This grounding is typically accomplished using a device called a bonding block or ground block. The bonding/ground block is usually located outside the home near the electrical service entry. Bonding is achieved by attaching the coaxial cable to the bonding block and attaching a wire from the electrical service ground to the bonding block. Because residential bonding blocks are usually outside the home, they are exposed to the elements such as rain, salt, sunlight, temperature extremes, and other harsh conditions. Since bonding blocks are primarily used as safety devices, it is imperative that they maintain a quality bond between the outer conductor of the coaxial cable and earth ground under these conditions.

Most existing ground blocks are made of inferior materials such as aluminum or zinc and corrode very quickly. Some are made of stainless steel but are constructed in such a way as to allow moisture to penetrate the interface between the coaxial cable and the bonding block, thus degrading the television signal and causing corrosion at the interface unless a weather seal is used.

Moreover, conventional metallic bonding/ground blocks typically use a set screw or a threading clamping mechanism to capture a first end of the grounding wire and to secure the grounding wire to the bonding/ground block for a long term, low contact resistant mechanical connection. The second end of the grounding wire is typically attached to a form of common bonding/grounding point at the point of installation, which may be, for example, private, residential, commercial, or contractual in nature. The second end is typically attached to the common bonding/grounding point by removing the outer covering to a recommended length, thus exposing the bare metallic wire for attachment. The attachment is typically achieved using a clamping device or a set screw that secures the wire to the bonding/grounding point for a low contact resistant mechanically sound connection. An exemplary ground block is illustrated in FIGS. 1 and 2, which is described in U.S. Pat. No. 7,462,042, the disclosure of which is incorporated herein by reference.

With conventional bonding/ground blocks, problems occur when an installer does not properly and/or sufficiently tighten the set screw or clamping device of the bonding/ground block, thus increasing the contact resistance and leading to a possible total disconnect. Increased contact resistance or total disconnect would cause the internal wiring of the installation to not be properly grounded or bonded to the remainder of the wiring at the installation location. Improper grounding/bonding could lead to RF ingress/egress of unwanted signals or, in the case of a lightning strike or electrical surge, to property damage, personal injury, or even death.

Accordingly, there is a need to overcome, or otherwise lessen the effects of, the disadvantages and shortcomings described above. Hence a need exists for an improved bonding/ground block that ensures a long term, low contact resistant mechanical connection and reliable electrical ground.

SUMMARY

According to various aspects of the disclosure, a ground block may include a metal ground plate and a ground wire fixedly coupled with the metal ground plate. The ground wire is configured to be non-detachable from the ground block during normal use of the ground block.

In some embodiments, the ground block may further include a connecting portion where the ground wire is coupled with the metal ground plate. The connecting portion may solder that solders the ground wire with the metal ground plate or filler metal that brazes the ground wire with the metal ground plate.

According to various aspects, the ground block may further include a second connecting portion, which includes a seizure screw assembly. The seizure screw assembly is configured to electrically couple the ground wire to the metal ground plate in the event that the ground wire becomes unintentionally detached from the metal ground plate during abnormal use.

According to some aspects of the ground block, the ground wire includes a first end connected to the ground block at the connection portion and a second end, and the ground block includes a terminal lug fixedly coupled with the second end of the ground wire by soldering, brazing, or mechanical bonding. The terminal lug and the ground wire are configured to be permanently connected to one another during normal use of the ground block.

In some aspects, the ground block includes a first flat portion, a second flat portion orthogonal to the first flat portion, and a third flat portion parallel to the second flat portion and orthogonal to the first flat portion. The first flat portion, the second flat portion, and the third flat portion may comprise a single monolithic piece of an electrically conductive metal.

According to various aspects, the first flat portion of the ground block may be configured to receive a connector body, and the connector body may be configured to couple two runs of coaxial cable.

In some embodiments, the ground block may further include a connecting portion where the ground wire is coupled with the metal ground plate. The connecting portion may include at least one deformable clamping member being deformable from a first position defining an opening configured to receive the ground wire to a second crimped position configured to clamp the ground wire to the metal ground plate In accordance with various aspect of the disclosure, a method of forming a ground block may include fixedly coupling a ground wire with a metal ground plate such that the ground wire is configured to be non-detachable from the ground block during normal use of the ground block. The ground block may be formed by soldering or brazing the ground wire to the metal ground plate at a connection portion.

In some aspects, the method may further include providing the metal ground plate with a second connecting portion that includes a seizure screw assembly, wherein the seizure screw assembly is configured to electrically couple the ground wire to the metal ground plate in the event that the ground wire becomes unintentionally detached from the metal ground plate during abnormal use.

According to some aspects, a first end of the ground wire is connected to the ground block at the connection portion, and a terminal lug is soldered, brazed, or mechanically bonded to a second end of the ground wire. The terminal lug and the ground wire are configured to be permanently connected to one another during normal use of the ground block.

In various aspects, the method of forming a ground block may further include cutting a piece of electrically conductive metal to delineate a first flat portion, a second flat portion, and a third flat portion, bending the third flat portion backwards until the third flat portion is substantially orthogonal to the first flat portion, and bending the second flat portion forwards until the second flat portion is substantially orthogonal to the first flat portion. The first end of the ground wire may be soldered or brazed to the first flat portion, the second flat portion, or the third flat portion at the connection portion.

In some aspects, the step of fixedly coupling may include providing at least one deformable clamping member having a first position defining an opening configured to receive the ground wire, and crimping the at least one deformable member to a second position configured to clamp the ground wire to the metal ground plate at a connection portion.

According to various aspects of the disclosure, a ground block includes a metal ground plate, a connector body, a ring terminal, a dress ring, and a ground wire fixedly coupled with the ring terminal. The metal ground plate includes a first flat portion including a through hole, a second flat portion orthogonal to the first flat portion, and a third flat portion parallel to the second flat portion and orthogonal to the first flat portion. The connector body is received in the through hole of the first flat portion, has first and second threaded end portions and an unthreaded portion between the first and second threaded end portions, and includes a flange portion extending radially outward from the unthreaded portion. The ring terminal surrounds the connector body and is sandwich between the flange portion and the first flat portion. The dress ring is fixedly mounted on the unthreaded portion on an opposite side of the first flat portion relative to the ring terminal and flange portion. The first flat portion, the second flat portion, and the third flat portion comprise a single monolithic piece of an electrically conductive metal, and the clamped ground wire is configured to be non-detachable from the metal ground plate during normal use of the ground block.

In some aspects, the ground block includes a terminal lug fixedly coupled with a second end of the ground wire by soldering, brazing, or mechanical bonding. The terminal lug and the ground wire are configured to be permanently connected to one another during normal use of the ground block.

According to various aspects, the connector body may be configured to couple two runs of coaxial cable.

In accordance with various aspect of the disclosure, a method of forming a ground block may include fixedly coupling a ring terminal with a metal ground plate such that the ground wire is configured to be non-detachable from the ground block during normal use of the ground block.

According to various aspects of the disclosure, a ground block includes a metal ground plate, a connector body, a dress ring, a ground wire, a connecting portion, and a shear screw. The metal ground plate includes a first flat portion including a through hole, a second flat portion orthogonal to the first flat portion, and a third flat portion parallel to the second flat portion and orthogonal to the first flat portion. The connector body is received in the through hole of the first flat portion, has first and second threaded end portions and an unthreaded portion between the first and second threaded end portions, and includes a flange portion extending radially outward from the unthreaded portion. The connecting portion is configured to fixedly couple the ground wire with the metal ground plate, and the shear screw is configured to tighten the ground wire to the connecting portion at a desired torque. The connecting portion includes a threaded opening configured to threadingly receive the shear screw, and the shear screw includes a head that is configured to break away from a body of the shear screw when the shear screw is tightened to a desired torque, thereby providing a visual confirmation that the shear screw has tightened the ground wire to the ground block at the desired torque and preventing the shear screw from being removed from the connecting portion during normal operation of the ground block.

In some aspects, the ground block includes a terminal lug fixedly coupled with a second end of the ground wire by soldering, brazing, or mechanical bonding. The terminal lug and the ground wire are configured to be permanently connected to one another during normal use of the ground block.

According to various aspects, the connector body may be configured to couple two runs of coaxial cable.

In accordance with various aspect of the disclosure, a method of forming a ground block may include fixedly coupling a ring terminal with a metal ground plate such that the ground wire is configured to be non-detachable from the ground block during normal use of the ground block.

In various aspects, the methods of forming a ground block may further include cutting a piece of electrically conductive metal to delineate a first flat portion, a second flat portion, and a third flat portion, bending the third flat portion backwards until the third flat portion is substantially orthogonal to the first flat portion, and bending the second flat portion forwards until the second flat portion is substantially orthogonal to the first flat portion. The first end of the ground wire may be soldered or brazed to the first flat portion, the second flat portion, or the third flat portion at the connection portion.

According to some embodiments, the methods may further comprise cutting a hole in the first flat portion, and press-fitting a connector body into the hole. The connector body may be configured to couple two runs of coaxial cable.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
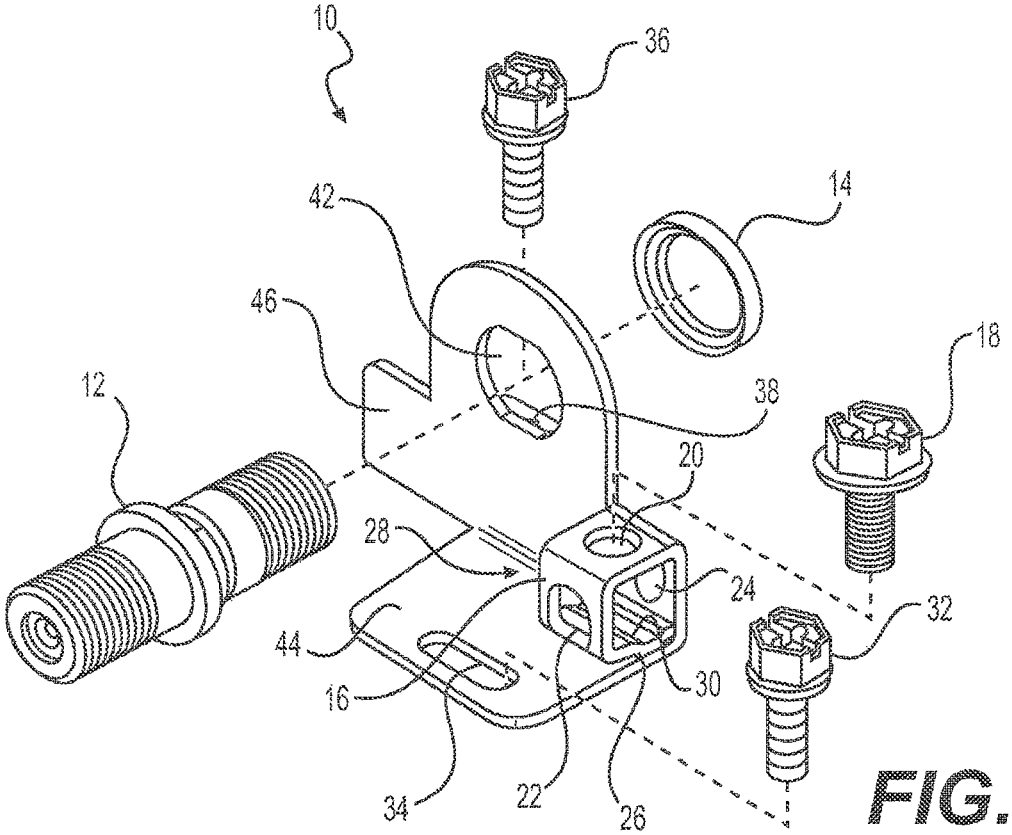
FIG. 1 (PRIOR ART)
FIG. 1 shows a front perspective view of a conventional bonding/ground block.
Figure 2:
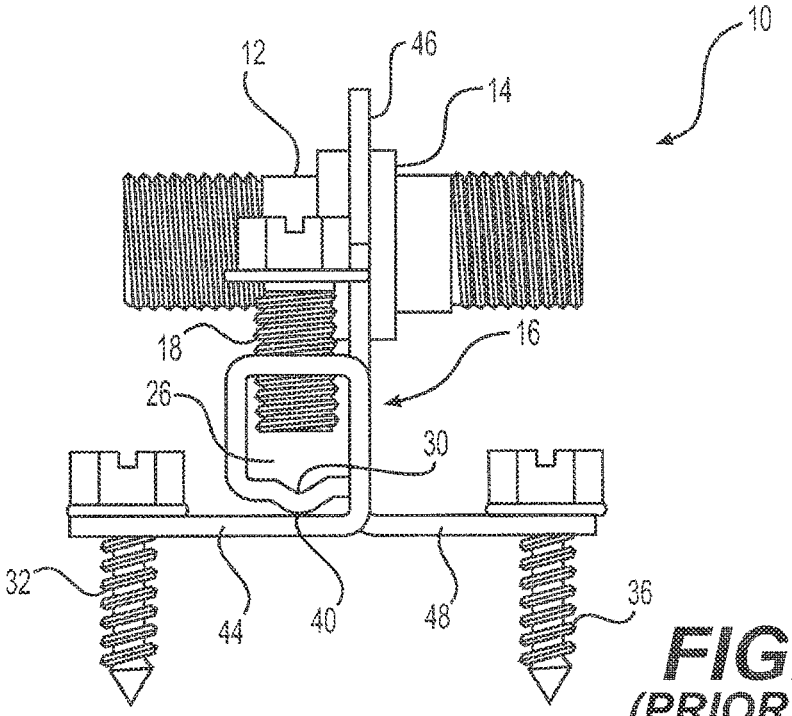
FIG. 2 (PRIOR ART)
FIG. 2 shows a side elevation view of a conventional bonding/ground block.

Referring to FIGS. 1 and 2, a conventional bonding/ground block 10 may include a first flat portion 46, a second flat portion 44 preferably orthogonal to the first flat portion 46, and a third flat portion 48 preferably parallel to the second flat portion 44 and orthogonal to the first flat portion 46. The first, second, and third flat portions 46, 44, 48 may be cut and folded from a single monolithic piece of stainless steel, thus providing excellent electrical conductivity between the portions.

A hole 42 within the first flat portion 46 is preferably dimensioned to receive a connector body 12 which is preferably of a material suitably corrosion resistant, such as brass, and press-fitted into the hole 42. After the connector body 12 is press-fitted into the hole 42, a dress ring 14 may be press-fitted from a first direction onto the connector body 12 from a second direction opposite the first direction, thus forming a press-fit and stake connection between the connector body 12 and the first flat portion 46. Because the connector body 12 is press-fitted to the first flat portion 46, it is relatively easy to weather seal the connection because of the flat areas of the connector body 12 on either side of the first flat portion 46, i.e., because the connector body 12 is not screwed into the hole 42, there are no threads which need to be weather-sealed.

The bonding block 10 includes a connecting portion 16. The connecting portion 16 is preferably a one-piece folded metal frame with a hole 20 for a seizure screw 18 which, when screwed in, holds a ground wire (not shown) in place to effect a very low-resistance corrosion-resistant ground path from the ground wire through connecting portion 16, second flat portion 44, and first flat portion 46 to connector body 12. The connecting portion 16 and the first, second, and third flat portions 46, 44, 48 may comprise a single monolithic piece of an electrically conductive metal. Although connecting portion 16 includes a groove 30 to help seize the ground wire when the ground wire is inserted through an aperture 26 or an aperture 28, the ground wire can also be inserted into connecting portion 16 through an aperture 22 or an aperture 24. Connecting portion 16 is preferably welded to flat portion 44 at a weld point 40 to provide additional strength to connection portion 16. A plurality of mounting screws 32, 36 fit into holes 34, 38, respectively, in flat portions 44, 48, respectively, to mount bonding block 10 to a wall or other structure during installation.

Figure 3:
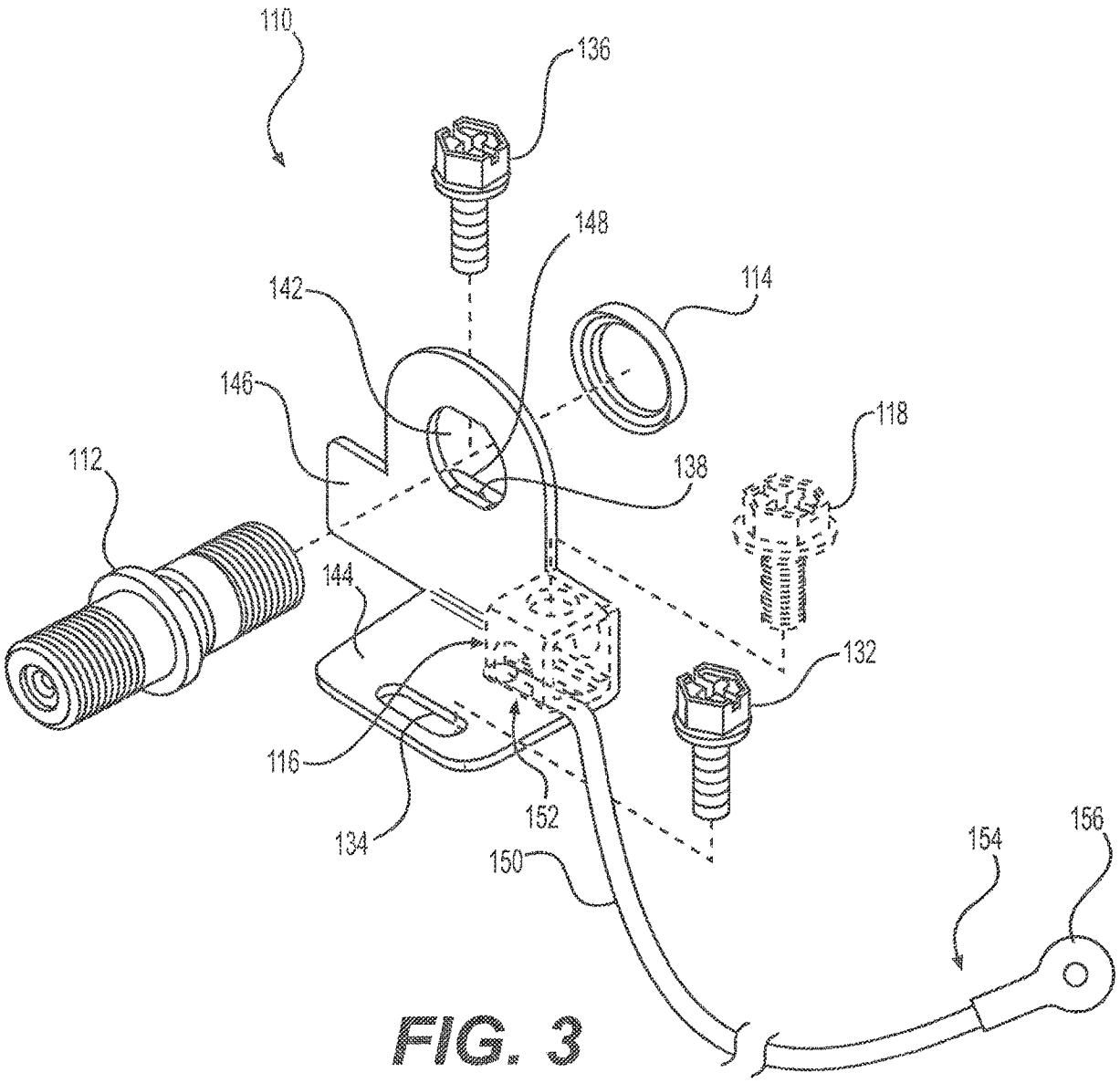
FIG. 3 shows a front perspective view of an exemplary bonding/ground block in accordance with various aspects of the disclosure.

Referring now to FIG. 3, an exemplary bonding/ground block 110 in accordance with various aspects of the disclosure is shown. The ground block 110 may include a first flat portion 146, a second flat portion 144 preferably orthogonal to the first flat portion 146, and a third flat portion 148 preferably parallel to the second flat portion 144 and orthogonal to the first flat portion 146. The first, second, and third flat portions 146, 144, 148 may be cut and folded from a single monolithic piece of stainless steel, thus providing excellent electrical conductivity between the portions.

A hole 142 within the first flat portion 146 is preferably dimensioned to receive a connector body 112 which is preferably of a material suitably corrosion resistant, such as brass, and press-fitted into the hole 142. The connector body 112 may be any known or conventional connector body. After the connector body 112 is press-fitted into the hole 142, a dress ring 114 may be press-fitted from a first direction onto the connector body 112 from a second direction opposite the first direction, thus forming a press-fit and stake connection between the connector body 112 and the first flat portion 146. In an embodiment where the connector body 112 is press-fitted to the first flat portion 146, it may be relatively easy to weather seal the connection because of the flat areas of the connector body 112 on either side of the first flat portion 146, i.e., because the connector body 112 is not screwed into the hole 142, there are no threads which need to be weather-sealed.

The ground block 110 includes a ground wire 150 fixedly coupled with the ground block 110 at a connecting portion 116. For example, the ground wire 150 may be attached to the ground block 110 by soldering or brazing the wire directly to the ground block 150. For example, the ground wire 150 may be soldered or brazed directly to the first, second, or third flat portion 146, 144, 148, respectively. The embodiment illustrated in FIG. 3 shows the ground wire 150 soldered or brazed to the second flat portion 144 at the connection portion 116. Thus, the need for a seizure screw is eliminated, and the ground wire 150 is configured to be non-detachable from the ground block 110 during normal use of the ground block 110. Consequently, the ground block 110 may not include the connection point 16 and seizure screw 18 described with respect to the conventional ground block shown in FIGS. 1 and 2. However, in some embodiments, the ground block 110 may include a connection point 16 and a seizure screw 18 to reattach the ground wire 150 to the ground block 110 in the event that the ground wire 150 becomes unintentionally detached from the ground block 110 during abnormal use.

The ground wire 150 has a first end 152 connected to the ground block 110 at the connection portion 116 and a second end 154 that includes a terminal lug 156 that is fixedly coupled with the second end 154 of the ground wire 150 by soldering, brazing, or mechanical bonding. The connection between the terminal lug 156 and the ground wire 150 is configured to be permanent during normal use of the ground block 110. The ground wire 150 has a length selected such that the terminal lug 156 is attachable to a common bonding/ground point at the time of installation of the ground block 110. For example, ground blocks 110 according to the present disclosure may include ground wires 150 with different incremental fixed lengths such as, for example, 5 feet, 10 feet, 25 feet, 50 feet, etc.

The ground block 110 may include a plurality of mounting screws 132, 136 that fit into holes 134, 138, respectively, in flat portions 144, 148, respectively, to mount the ground block 110 to a wall or other structure during installation. Using a single monolithic blank of stainless steel provides a location for the ground wire 150 to attach at the connecting portion 116, which in turn is electrically connected through the first and second flat portions 144, 146 to the connector body 112, thus minimizing the number of separate, discrete contacts between the ground wire 150 and the metal connector body 112. The geometry of ground block 110 may be such that a weather seal or seals can be used to effectively seal the connection between connector body 112 and flat portion 146. Forming the ground block 110 from the stainless steel blank may be done by progressive die stamping, although laser cutting could be used.

A method of manufacturing a ground block may include the steps of forming a ground block and soldering or brazing a ground wire to the ground block. In one embodiment, a method of manufacturing the ground block 150 may include the steps of (a) cutting a single monolithic piece of stainless steel to delineate a first flat portion, a second flat portion, and a third flat portion; (b) cutting a round hole into the first flat portion; (c) cutting an elongated hole into the second flat portion to accommodate a mounting screw; (d) cutting an elongated hole into the third flat portion to accommodate a mounting screw; (e) bending the third flat portion backwards until the third flat portion is substantially orthogonal to the first flat portion; (f) bending the second flat portion forwards until the second flat portion is substantially orthogonal to the first flat portion; and (g) soldering or brazing a ground wire to the first flat portion, the second flat portion, or the third flat portion at a connection portion. It should be appreciated that the order of steps (a) through (g) may be modified according to preferred manufacturing processes.

Figure 4:
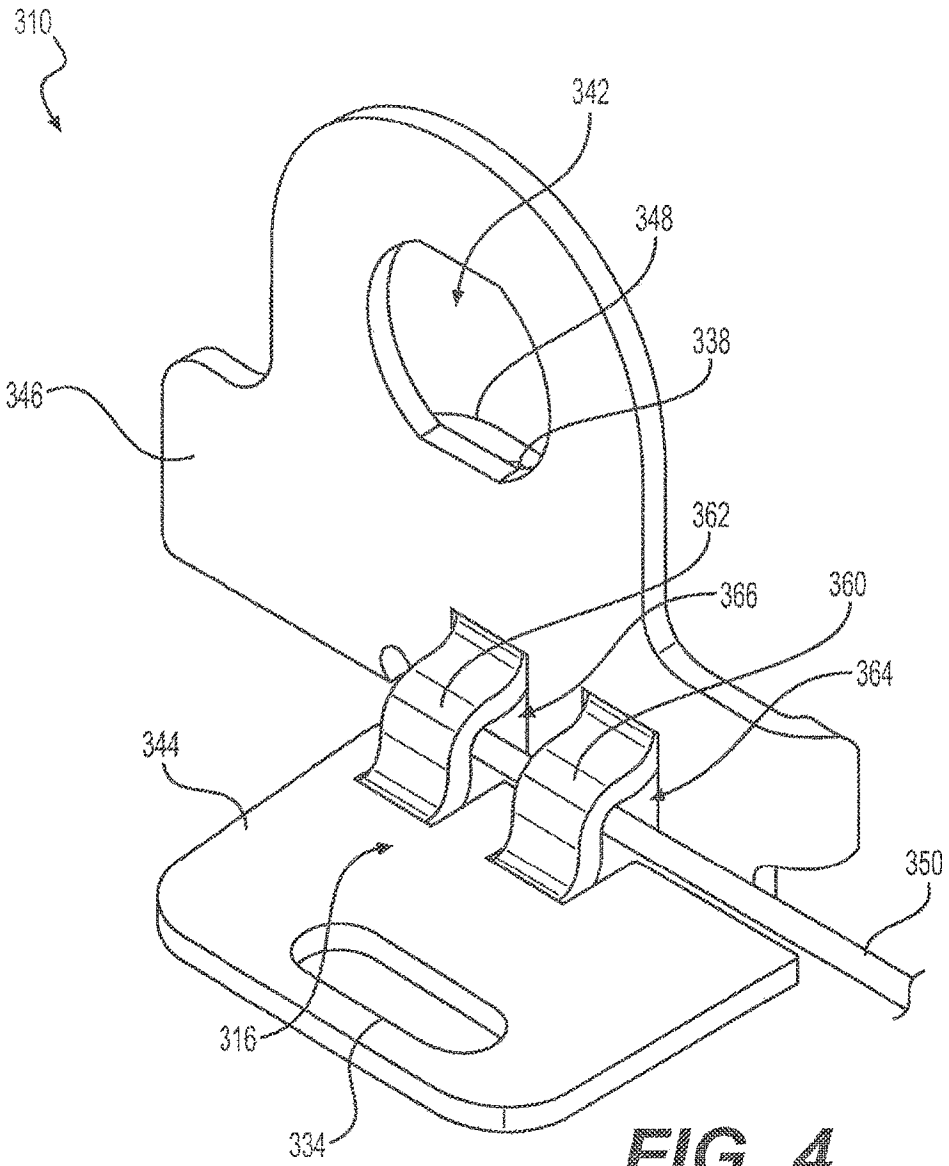
FIG. 4 shows a front perspective view of another exemplary bonding/ground block, in accordance with various aspects of the disclosure.
Figure 5:
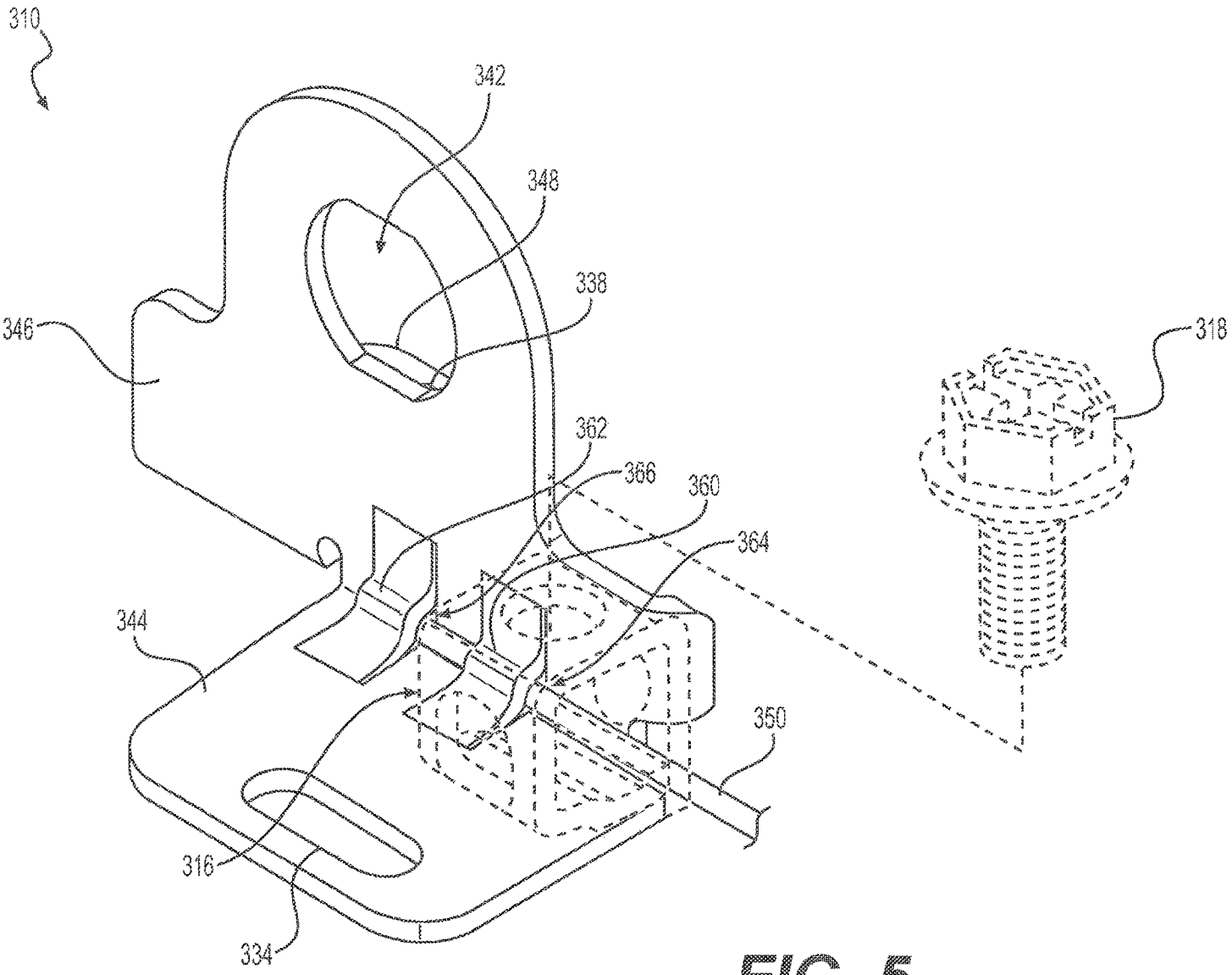
FIG. 5 shows a front perspective view of the exemplary bonding/ground block of FIG. 4 with a clamped ground wire.
Figure 6:
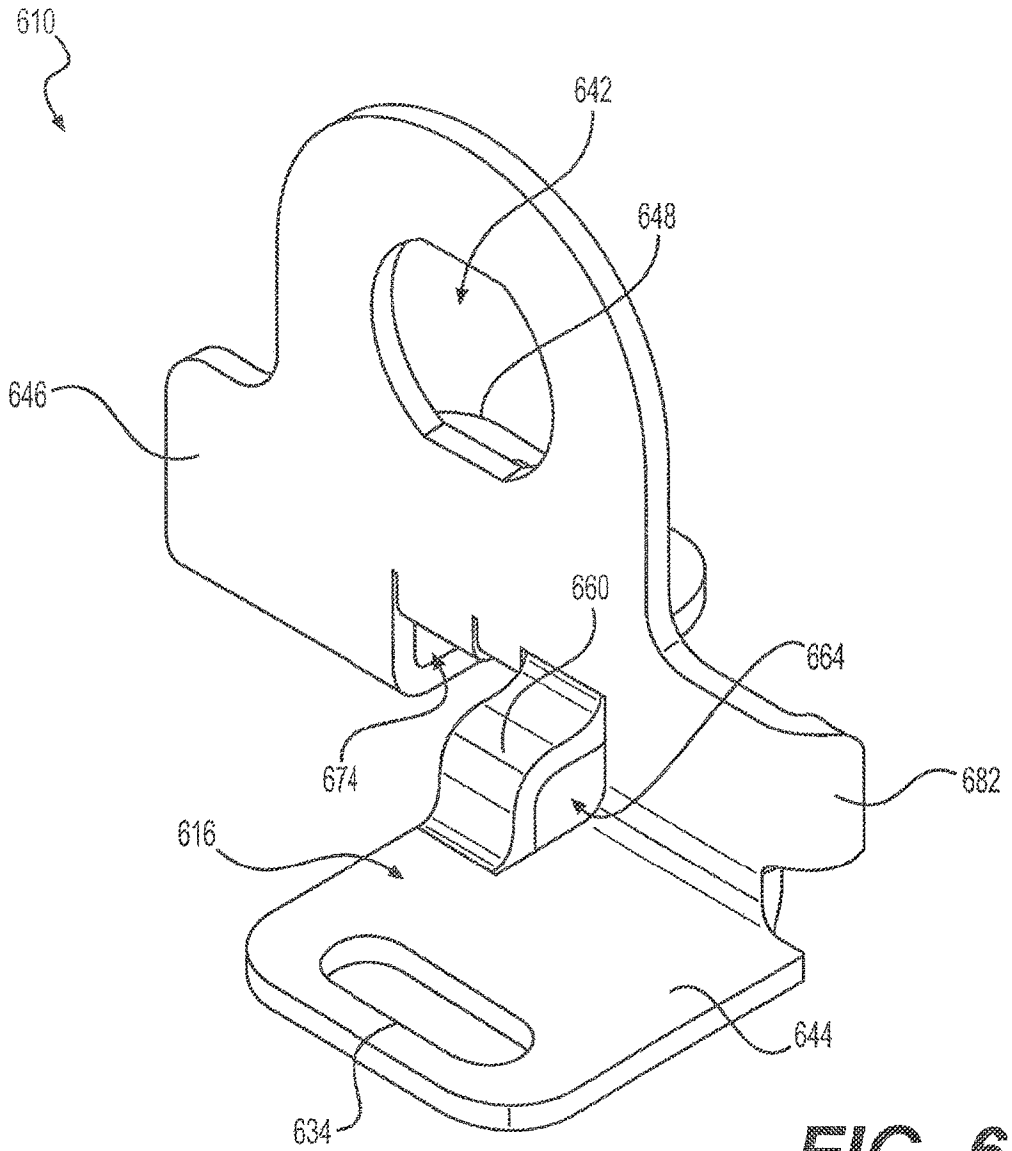
FIG. 6 shows a front perspective view of another exemplary bonding/ground block in accordance with various aspects of the disclosure.
Figure 7:
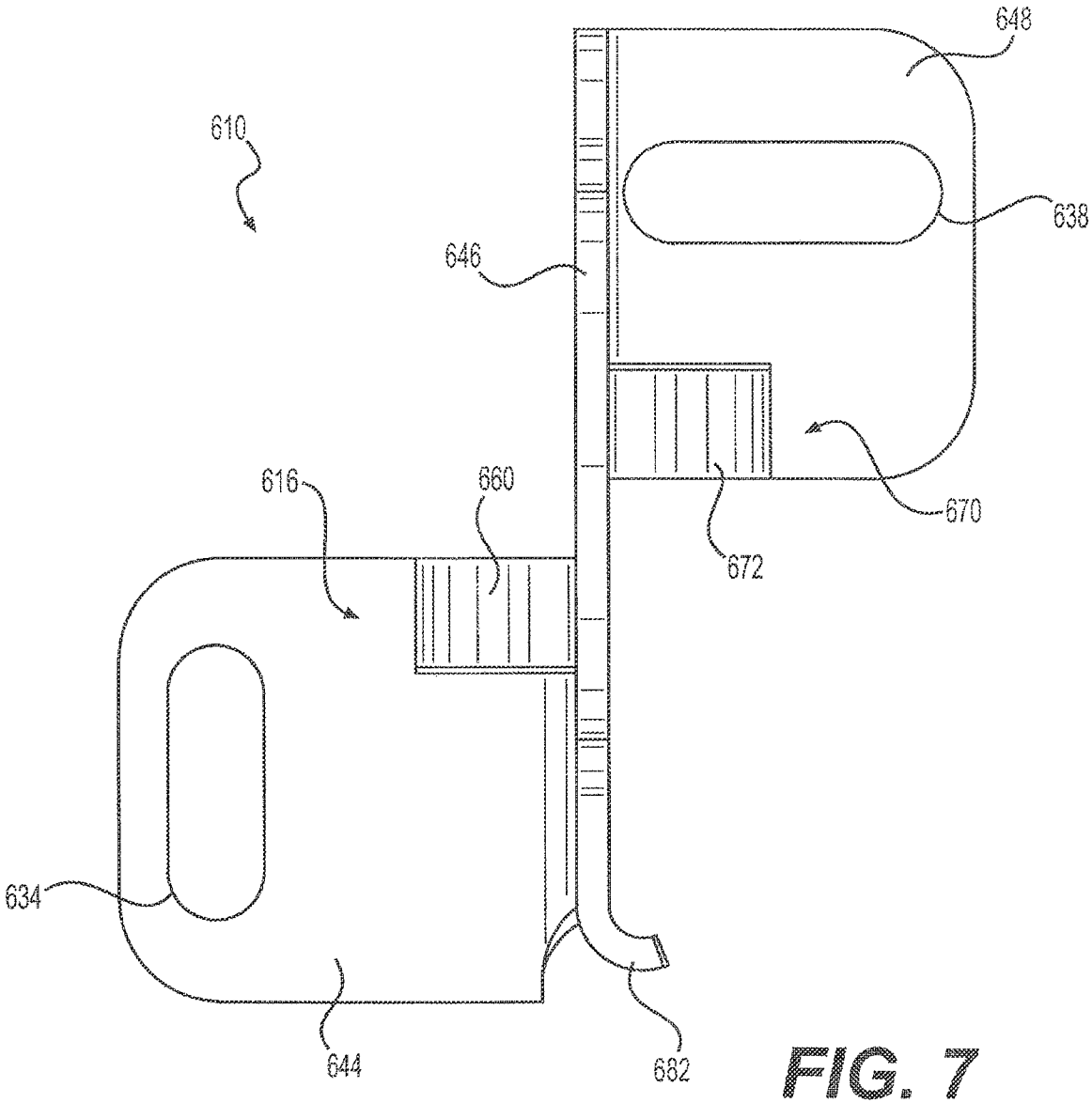
FIG. 7 shows a top view of the exemplary bonding/ground block of FIG. 6.
Figure 8:
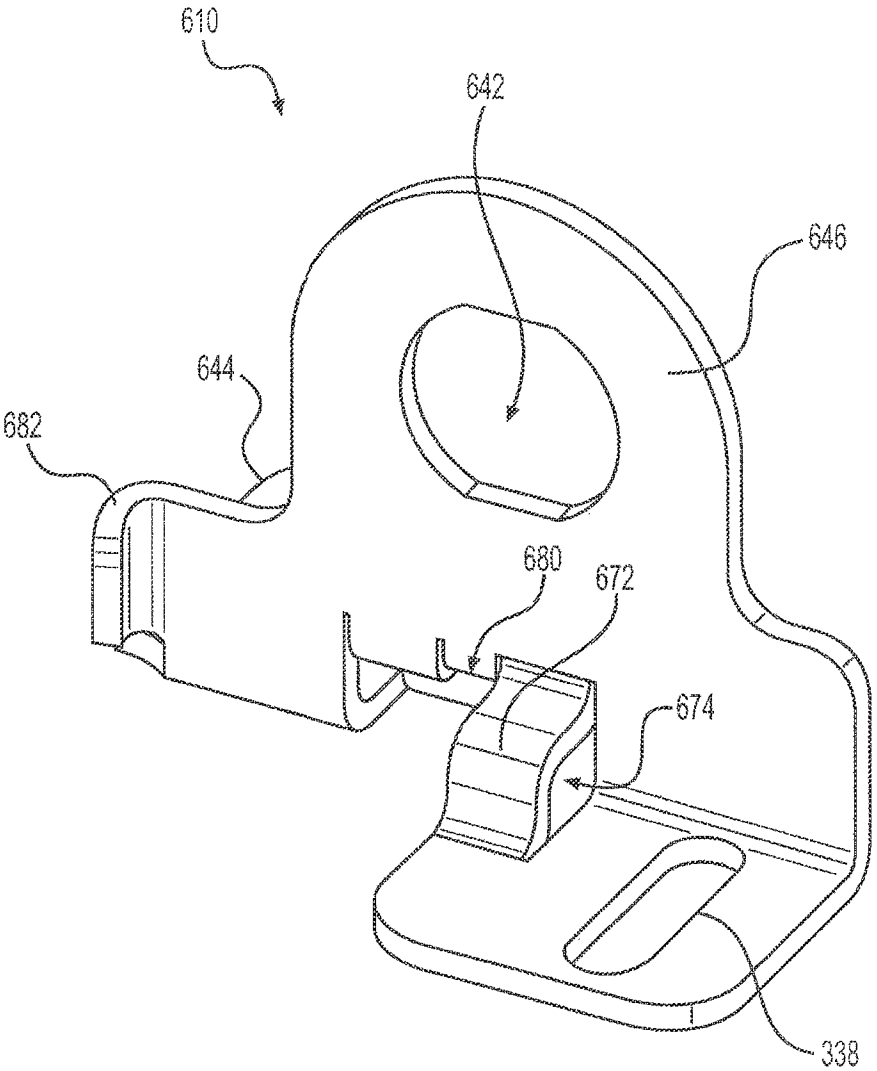
FIG. 8 shows a rear perspective view of the exemplary bonding/ground block of FIG. 6.

Referring now to FIGS. 4 and 5, another exemplary bonding/ground block 310 in accordance with various aspects of the disclosure is shown. The ground block 310 may include a first flat portion 346, a second flat portion 344 preferably orthogonal to the first flat portion 346, and a third flat portion 348 preferably parallel to the second flat portion 344 and orthogonal to the first flat portion 346. The first, second, and third flat portions 346, 344, 348 may be cut and folded from a single monolithic piece of stainless steel, thus providing excellent electrical conductivity between the portions.

A hole 342 within the first flat portion 346 is preferably dimensioned to receive a connector body 112 which is preferably of a material suitably corrosion resistant, such as brass, and press-fitted into the hole 342. The connector body 112 may be any known or conventional connector body. After the connector body 112 is press-fitted into the hole 342, a dress ring 114 may be press-fitted from a first direction onto the connector body 112 from a second direction opposite the first direction, thus forming a press-fit and stake connection between the connector body 112 and the first flat portion 346. In an embodiment where the connector body 112 is press-fitted to the first flat portion 346, it may be relatively easy to weather seal the connection because of the flat areas of the connector body 112 on either side of the first flat portion 346, i.e., because the connector body 112 is not screwed into the hole 342, there are no threads which need to be weather-sealed.

The ground block 310 includes a ground wire 350 fixedly coupled with the ground block 310 at a connecting portion 316. As illustrated in FIGS. 4 and 5, the connecting portion 316 may include one or more clamping members 360, 362. The clamping members 360, 362 may be part of a unitary monolithic structure (i.e., a single piece) with the second flat portion 344 and/or the first flat portions 346. For example, the clamping members 360, 362 may be defined by cutting, such as by laser cutting or any other metal cutting method, the second and/or first flat portions 344, 346 to delimit the clamping members 360, 362. The clamping members 360, 362 are then deformed to define openings 364, 366 for receiving the ground wire 350, as shown in FIG. 4.

Referring now to FIG. 5, after the ground wire 350 is received by the openings 364, 366 defined by the clamping members 360, 362, the clamping members 360, 362 are deformed, such as crimping or the like, back toward their original configuration prior to be cut from the second and/or first flat portions 344, 346 so as to clamp the ground wire 350 between the clamping members 360, 362 and the second and/or first flat portions 344, 346. Crimping of the clamping members 360, 362 reduces the size of the openings 364, 366 and may deform the ground wire 350 into an S-shaped configuration such that the ground wire is configured to be non-detachable from the ground block 310 during normal use of the ground block 310. That is, the crimped S-shaped configuration of the ground wire 350 prevents the ground wire 350 from being slidably removed from the ground block 310 during normal use of the ground block 310. Thus, the need for a seizure screw is eliminated. Consequently, the ground block 310 may not include the connection point 16 and seizure screw 18 described with respect to the conventional ground block shown in FIGS. 1 and 2. However, in some embodiments, the ground block 310 may include a connection point 16 and a seizure screw 18 to reattach the ground wire 350 to the ground block 310 in the event that the ground wire 350 becomes unintentionally detached from the ground block 310 during abnormal use. It should be appreciate that in some embodiments, the crimped ground wire 350 may be additionally attached to the ground block 310 by soldering or brazing the wire directly to the ground block 310.

The ground wire 350 has a first end 352 connected to the ground block 310 at the connection portion 316 and a second end (not shown) that may include a termination member, such as for example, a terminal lug (not shown) that is fixedly coupled with the second end of the ground wire 350 by soldering, brazing, or mechanical bonding. The connection between the terminal lug and the ground wire 350 is configured to be permanent during normal use of the ground block 310. The ground wire 350 has a length selected such that the terminal lug is attachable to a common bonding/ground point at the time of installation of the ground block 310. For example, ground blocks 310 according to the present disclosure may include ground wires 350 with different incremental fixed lengths such as, for example, 5 feet, 10 feet, 25 feet, 50 feet, etc.

The ground block 310 may include a plurality of mounting screws (not shown) that fit into holes 334, 338, respectively, in flat portions 344, 348, respectively, to mount the ground block 310 to a wall or other structure during installation. Using a single monolithic blank of stainless steel provides a location for the ground wire 350 to attach at the connecting portion 316, which in turn is electrically connected through the first and second flat portions 346, 344 to the connector body 112, thus minimizing the number of separate, discrete contacts between the ground wire 350 and the metal connector body 112. The geometry of the ground block 310 may be such that a weather seal or seals can be used to effectively seal the connection between connector body 112 and the first flat portion 346. Forming the ground block 310 from the stainless steel blank may be done by progressive die stamping, although laser cutting could be used.

Referring now to FIGS. 6-9, another exemplary bonding/ground block 610 in accordance with various aspects of the disclosure is shown. The ground block 610 may include a first flat portion 646, a second flat portion 644 preferably orthogonal to the first flat portion 646, and a third flat portion 648 preferably parallel to the second flat portion 644 and orthogonal to the first flat portion 646. The first, second, and third flat portions 646, 644, 648 may be cut and folded from a single monolithic piece of stainless steel, thus providing excellent electrical conductivity between the portions.

A hole 642 within the first flat portion 646 is preferably dimensioned to receive a connector body 112 which is preferably of a material suitably corrosion resistant, such as brass, and press-fitted into the hole 642. The connector body 112 may be any known or conventional connector body. After the connector body 112 is press-fitted into the hole 642, a dress ring 114 may be press-fitted from a first direction onto the connector body 112 from a second direction opposite the first direction, thus forming a press-fit and stake connection between the connector body 112 and the first flat portion 646. In an embodiment where the connector body 112 is press-fitted to the first flat portion 646, it may be relatively easy to weather seal the connection because of the flat areas of the connector body 112 on either side of the first flat portion 646, i.e., because the connector body 112 is not screwed into the hole 342, there are no threads which need to be weather-sealed.

Figure 9:
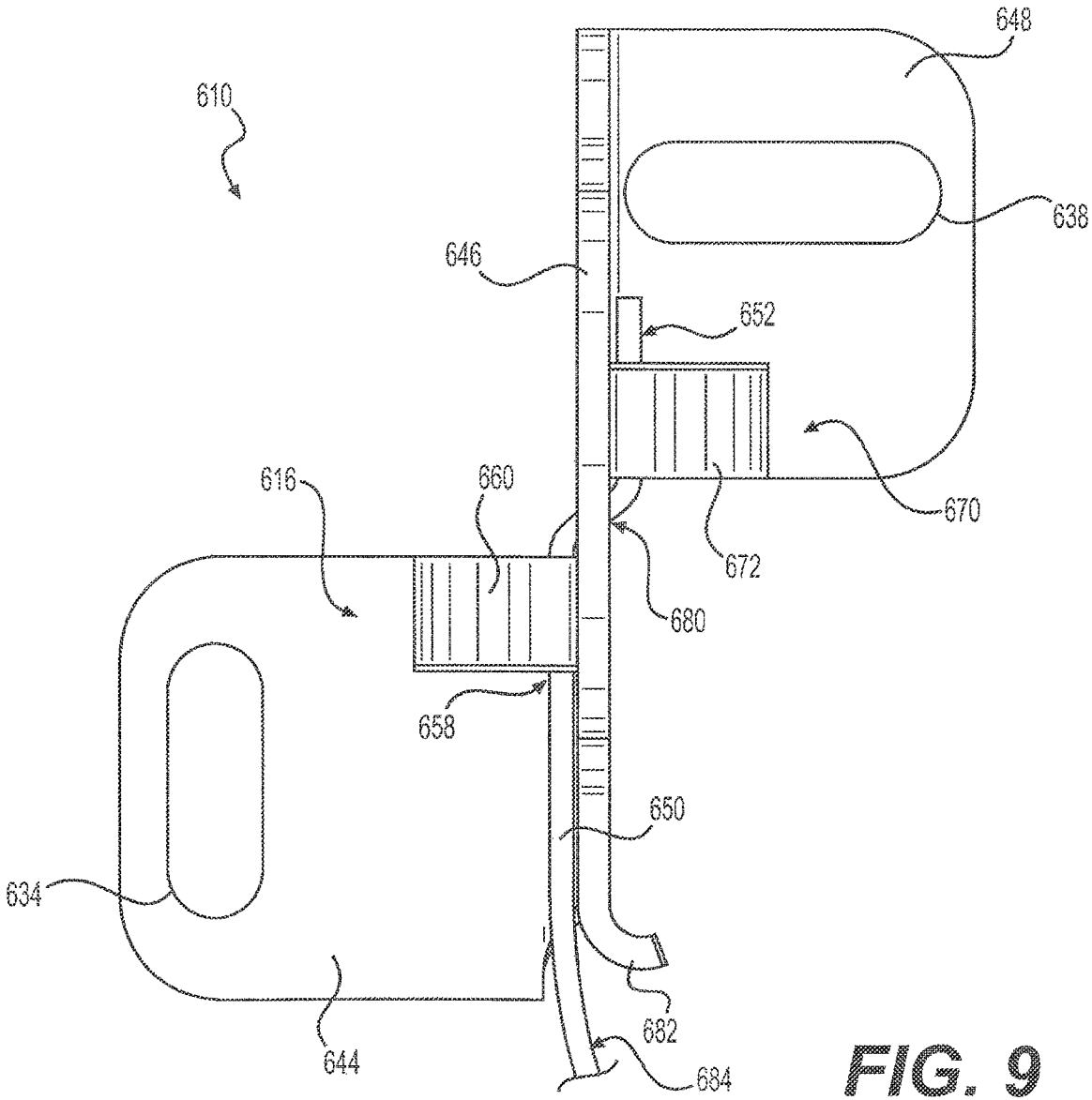
FIG. 9 shows a top view of the exemplary bonding/ground block of FIG. 6 with a clamped ground wire.

As shown in FIG. 9, the ground block 610 includes a ground wire 650 fixedly coupled with the ground block 610 at a first connecting portion 670 and a second connecting portion 616. The first connecting portion 670 may include a clamping member 672. The clamping member 672 may be part of a unitary monolithic structure (i.e., a single piece) with the first flat portion 646 and/or the third flat portion 648. For example, the clamping member 672 may be defined by cutting, such as by laser cutting or any other metal cutting method, the first and/or third flat portions 646, 648 to delimit the clamping member 672. The clamping member 672 is then deformed to define an opening 674 for receiving the ground wire 650.

The second connecting portion 616 may include a clamping member 660. The clamping member 660 may be part of a unitary monolithic structure (i.e., a single piece) with the second flat portion 644 and/or the first flat portion 646. For example, the clamping member 660 may be defined by cutting, such as by laser cutting or any other metal cutting method, the second and/or first flat portions 644, 646 to delimit the clamping member 660. The clamping member 660 is then deformed to define an opening 664 for receiving the ground wire 650. The openings 664, 674 are configured to receive the ground wire 650 on opposite sides of the first flat portion 646, and the clamping members 660, 672 are configured to clamp the ground wire on opposite side of the first flat portion 646.

In use, the ground wire 650 is disposed in the openings 664, 674 and extends through an opening 680 in the first flat portion 646 between the clamping members 660, 672. After the ground wire 650 is received by the openings 664, 674 defined by the clamping members 660, 672, the clamping members 660, 672 are deformed, such as crimping or the like, back toward their original configuration prior to being cut from the first, second, and/or third flat portions 646, 644, 648 so as to clamp the ground wire 650 between the clamping members 660, 672 and the first, second, and/or third flat portions 646, 644, 648. Crimping of the clamping members 660, 672 reduces the size of the openings 664, 674 and may deform the ground wire 650 into an S-shaped configuration such that the ground wire is configured to be non-detachable from the ground block 610 during normal use of the ground block 610. That is, the crimped S-shaped configuration of the ground wire 650 prevents the ground wire 650 from being slidably removed from the ground block 610 during normal use of the ground block 610. In particular, the ground block 610 is designed to meet the physical requirements of UL testing, including the ability to maintain a ground connection between the ground wire 650 and the ground block 610 to transfer 3000 amps with up to 100 lbs. of force hanging from the ground wire 650 at different angles.

Thus, the ground block 610 does not require a seizure screw for securing the ground wire 650 to the ground block 610. Consequently, the ground block 610 may not include the connection point 16 and seizure screw 18 described with respect to the conventional ground block shown in FIGS. 1 and 2. However, in some embodiments, the ground block 610 may include a connection point 16 and a seizure screw 18 to reattach the ground wire 650 to the ground block 610 in the event that the ground wire 650 becomes unintentionally detached from the ground block 610 during abnormal use. It should be appreciate that in some embodiments, the crimped ground wire 650 may be additionally attached to the ground block 610 by soldering or brazing the wire directly to the ground block 610.

Referring again to FIG. 9, the ground wire 650 has a first end 652 connected to the ground block 610 at the first connection portion 670 and a second portion 658, spaced from the first end 652, connected to the ground block 610 at the second connection portion 616. Similar to ground wire 150, a second end (not shown) of the ground wire 650 may include a termination member, such as for example, a terminal lug (not shown) that is fixedly coupled with the second end of the ground wire 650 by soldering, brazing, or mechanical bonding. In some aspects, the first flat portion 646 may include a rounded end wall 682 configured to limit the bend radius of the ground wire to a minimum radius in the event that a third portion 684 of the ground wire 650 between the second portion 658 and the second end is wrapped around the first flat portion 646 and directed back toward the third flat portion 648.

The connection between the terminal lug and the ground wire 650 is configured to be permanent during normal use of the ground block 610. The ground wire 650 has a length selected such that the terminal lug is attachable to a common bonding/ground point at the time of installation of the ground block 610. For example, ground blocks 610 according to the present disclosure may include ground wires 650 with different incremental fixed lengths such as, for example, 5 feet, 10 feet, 25 feet, 50 feet, etc.

The ground block 610 may include a plurality of mounting screws (not shown) that fit into holes 634, 638, respectively, in flat portions 644, 648, respectively, to mount the ground block 610 to a wall or other structure during installation. Using a single monolithic blank of stainless steel provides a location for the ground wire 650 to attach at the connecting portion 616, which in turn is electrically connected through the first, second, and third flat portions 646, 644, 648 to the connector body 112, thus minimizing the number of separate, discrete contacts between the ground wire 650 and the metal connector body 112. The geometry of the ground block 610 may be such that a weather seal or seals can be used to effectively seal the connection between connector body 112 and the first flat portion 646. Forming the ground block 610 from the stainless steel blank may be done by progressive die stamping, although laser cutting could be used.

Figure 10:
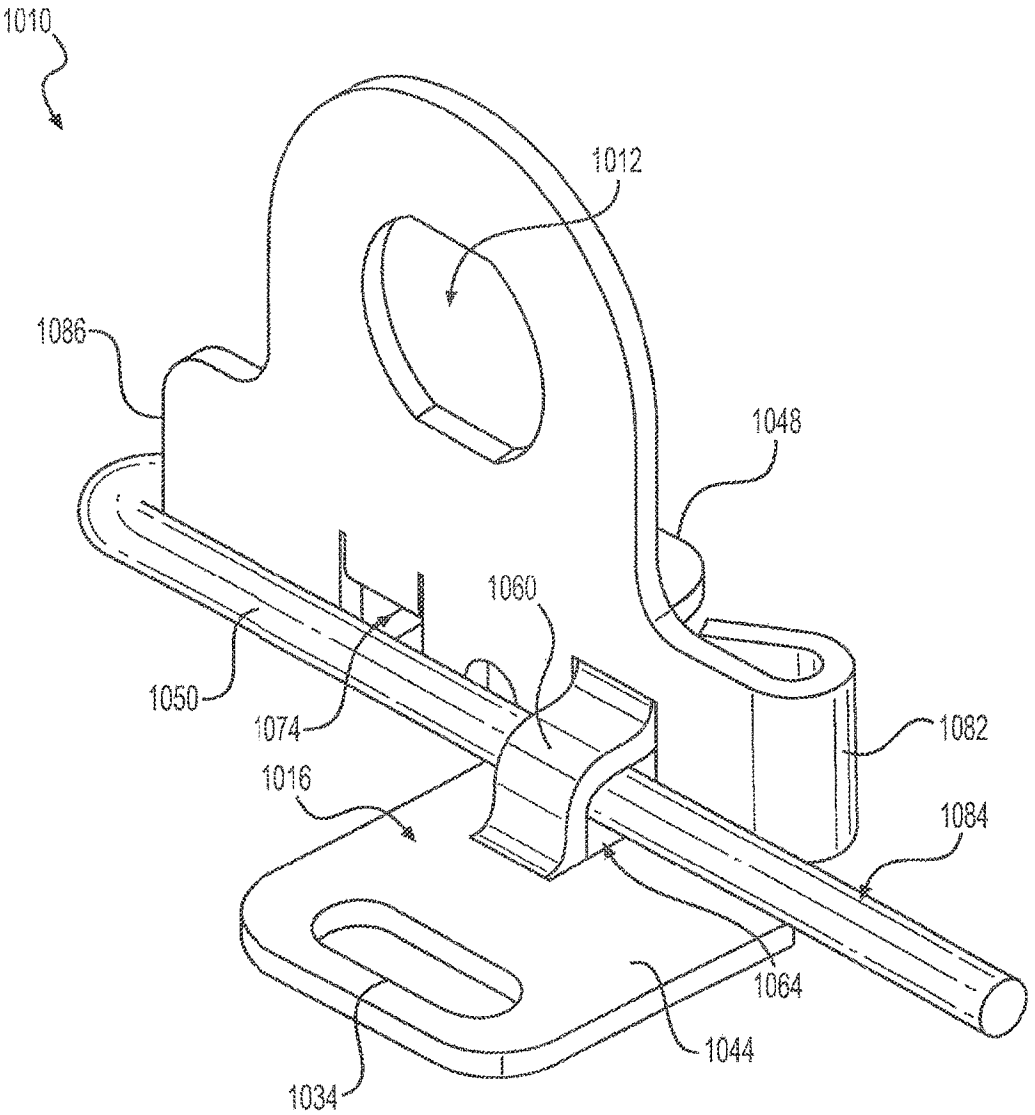
FIG. 10 shows a front perspective view of another exemplary bonding/ground block with a clamped ground wire in accordance with various aspects of the disclosure.
Figure 11:
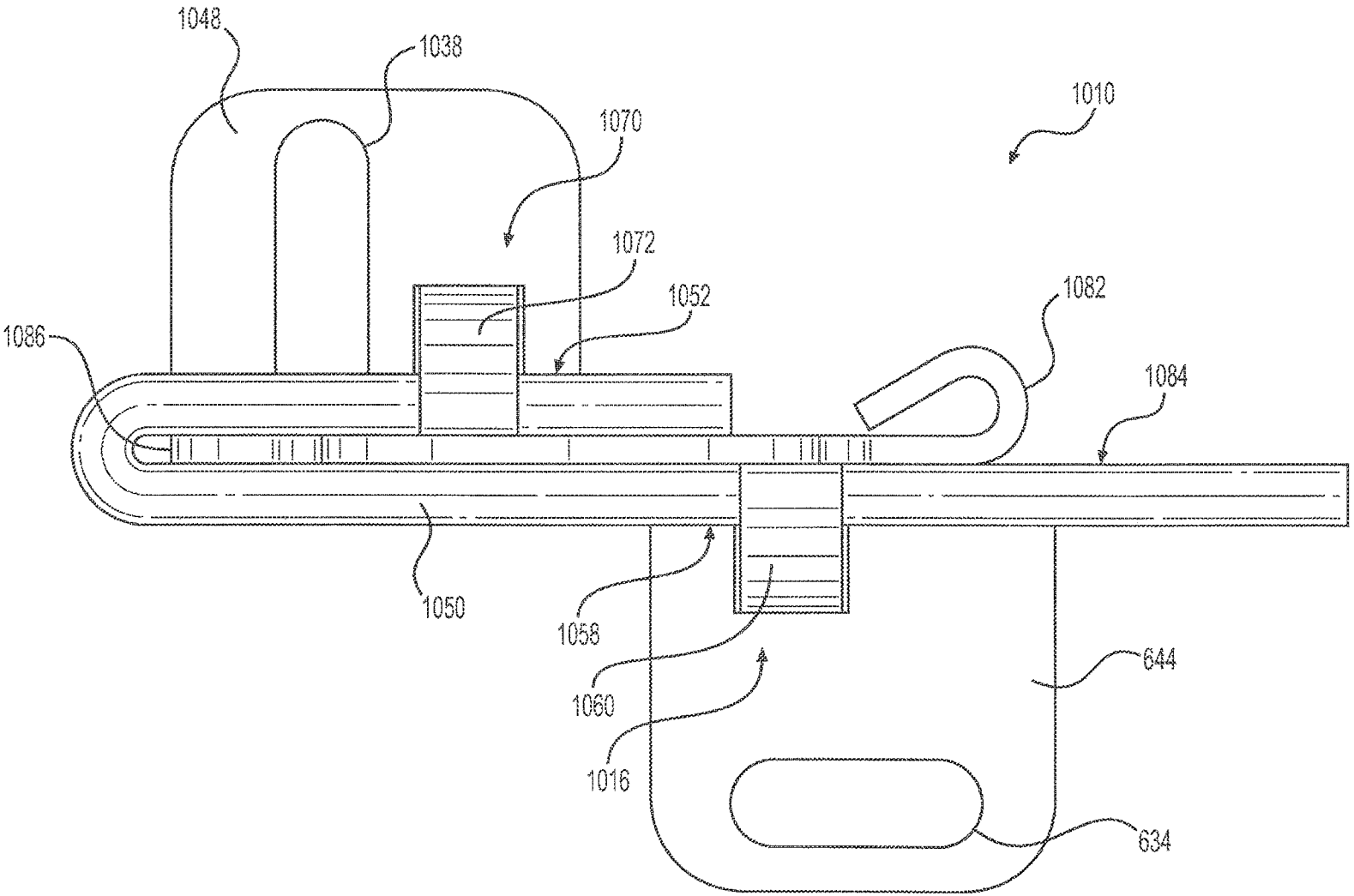
FIG. 11 shows a top view of the exemplary bonding/ground block and clamped ground wire of FIG. 10.
Figure 12:
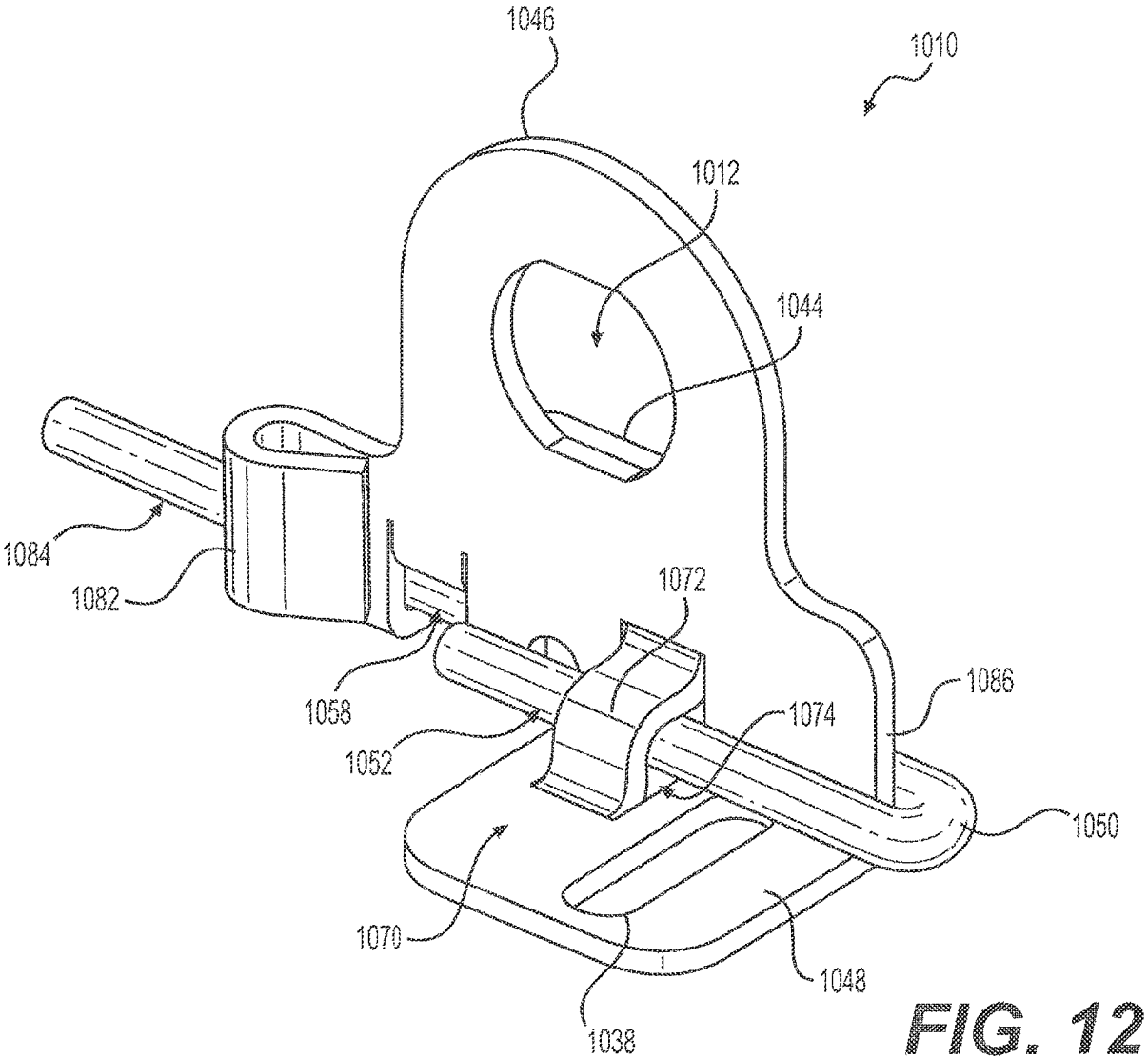
FIG. 12 shows a rear perspective view of the exemplary bonding/ground block and clamped ground wire of FIG. 10.
Figure 13:
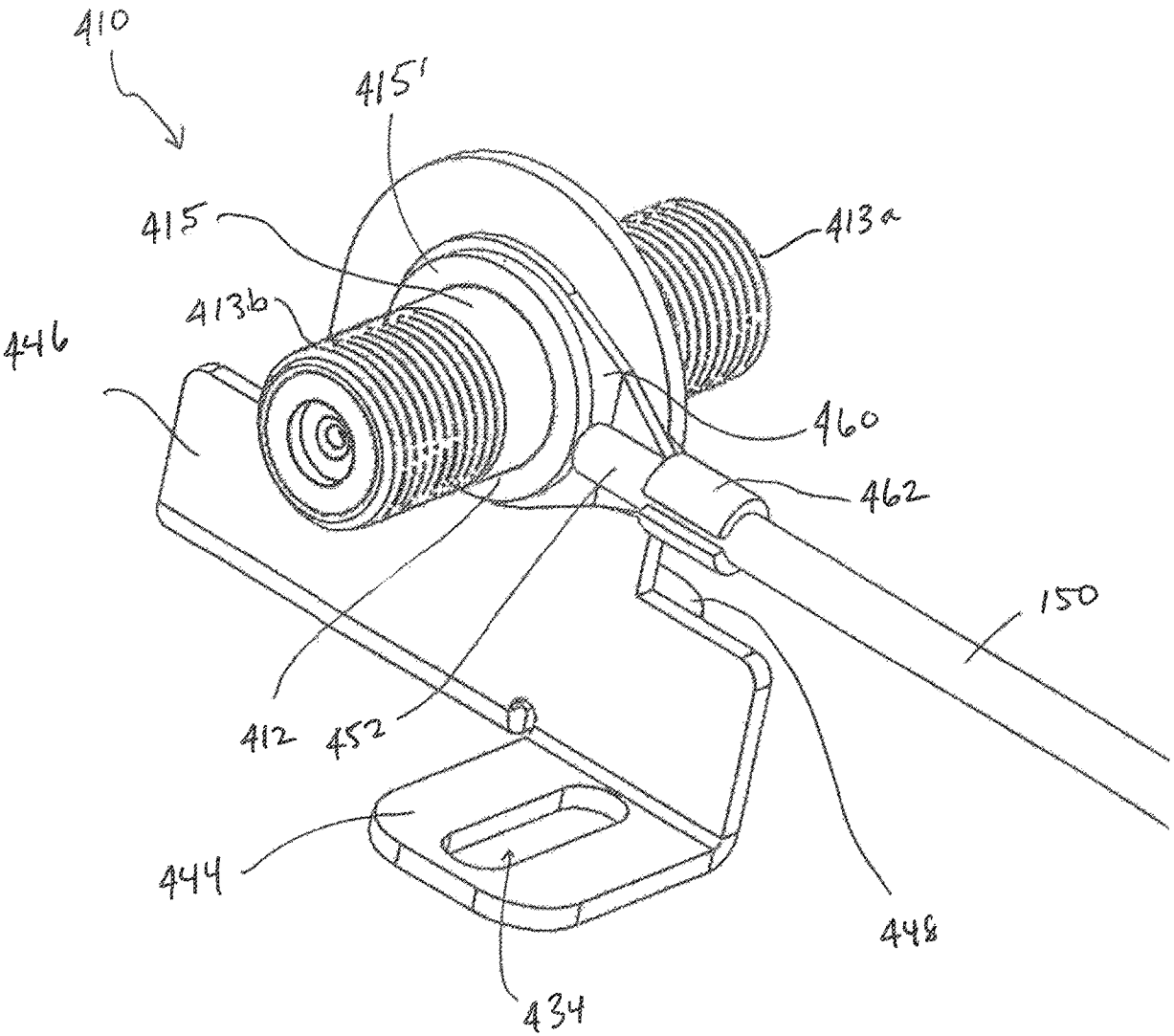
FIG. 13 shows a front perspective view of an exemplary bonding/ground block in accordance with various aspects of the disclosure.
Figure 14:
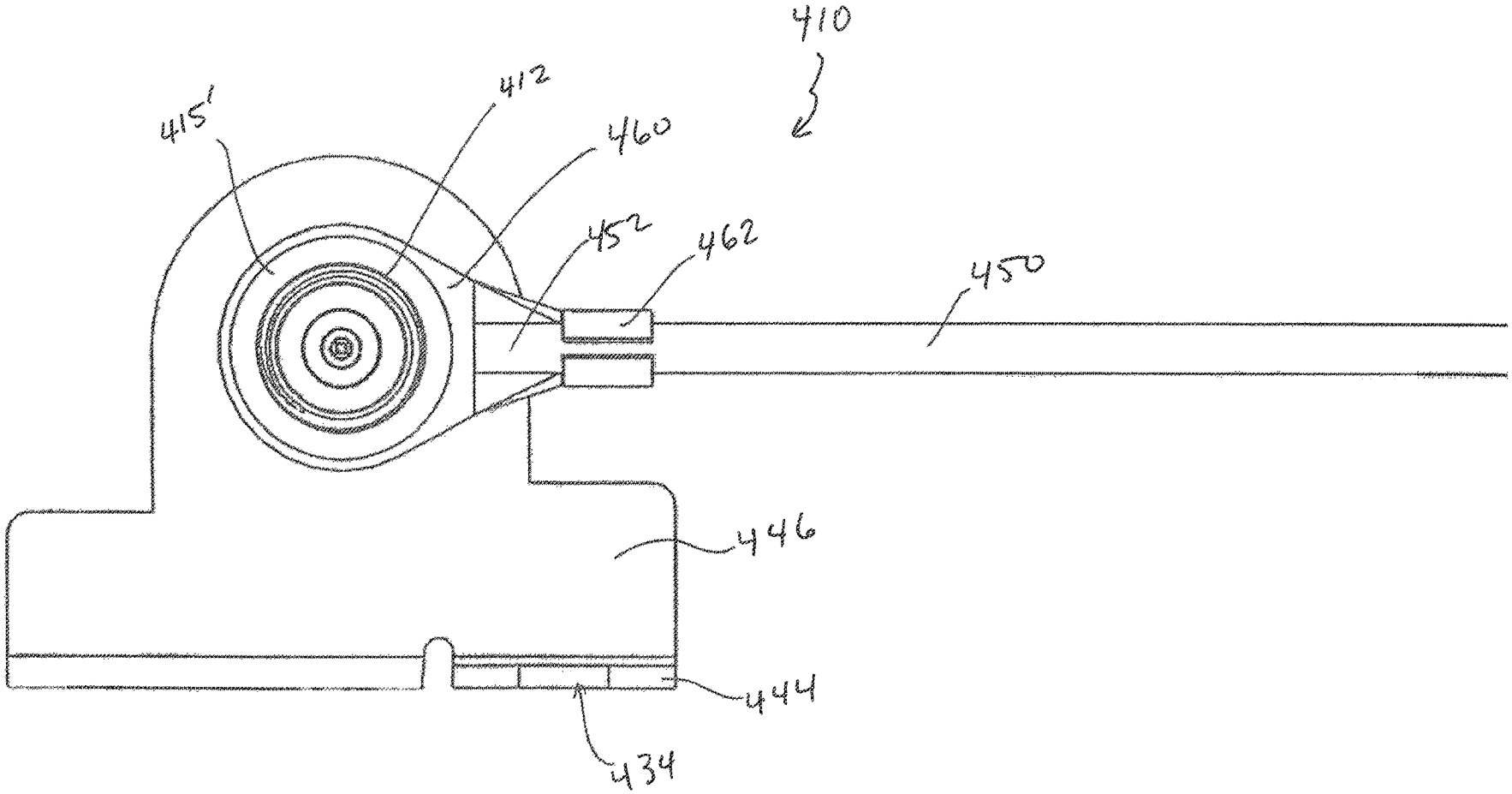
FIG. 14 shows a front view of the exemplary bonding/ground block of FIG. 13.
Figure 15:
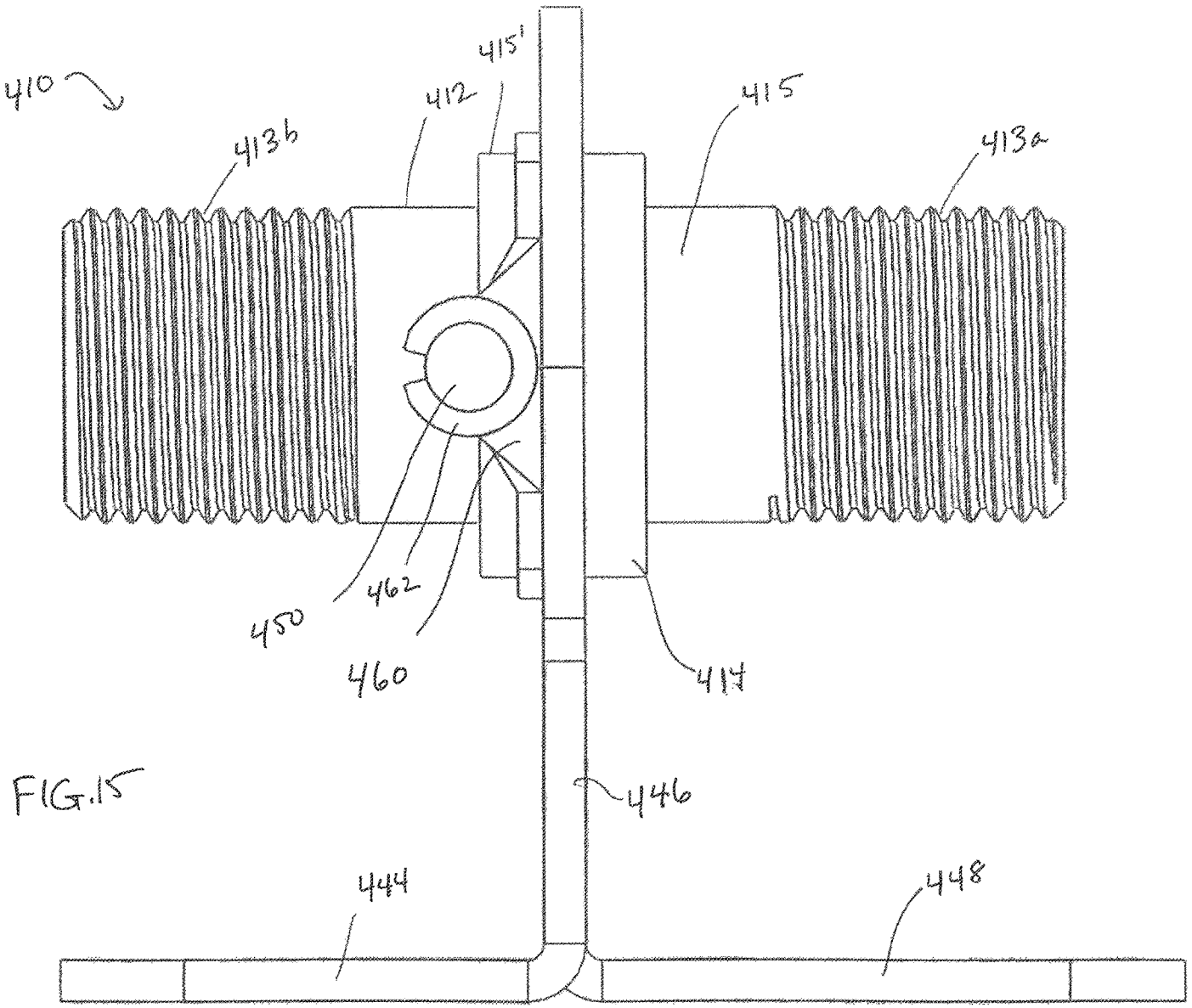
FIG. 15 shows a side view of the exemplary bonding/ground block of FIG. 13.
Figure 16:
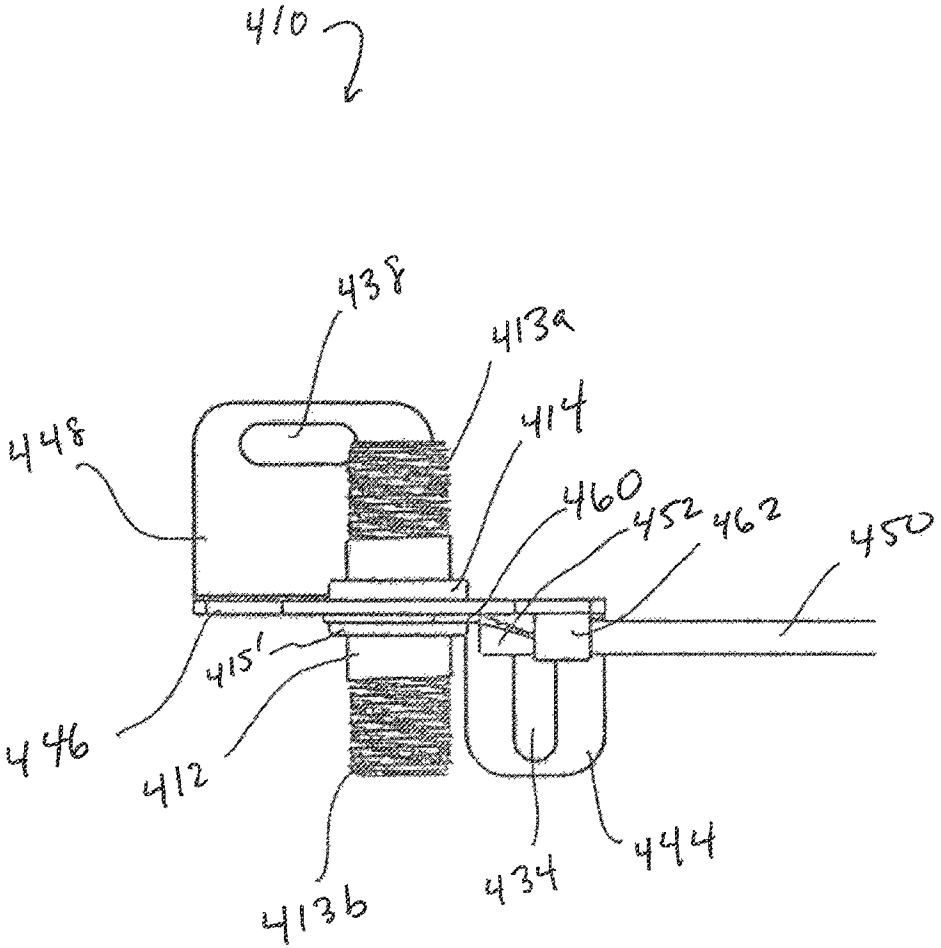
FIG. 16 shows a top view of the exemplary bonding/ground block of FIG. 13.

Referring now to FIGS. 10-12, another exemplary bonding/ground block 1010 in accordance with various aspects of the disclosure is shown. The ground block 1010 may include a first flat portion 1046, a second flat portion 1044 preferably orthogonal to the first flat portion 1046, and a third flat portion 1048 preferably parallel to the second flat portion 1044 and orthogonal to the first flat portion 1046. The first, second, and third flat portions 1046, 1044, 1048 may be cut and folded from a single monolithic piece of stainless steel, thus providing excellent electrical conductivity between the portions.

A hole 1042 within the first flat portion 1046 is preferably dimensioned to receive a connector body 112 which is preferably of a material suitably corrosion resistant, such as brass, and press-fitted into the hole 1042. The connector body 112 may be any known or conventional connector body. After the connector body 112 is press-fitted into the hole 1042, a dress ring 114 may be press-fitted from a first direction onto the connector body 112 from a second direction opposite the first direction, thus forming a press-fit and stake connection between the connector body 112 and the first flat portion 1046. In an embodiment where the connector body 112 is press-fitted to the first flat portion 1046, it may be relatively easy to weather seal the connection because of the flat areas of the connector body 112 on either side of the first flat portion 1046, i.e., because the connector body 112 is not screwed into the hole 342, there are no threads which need to be weather-sealed.

As shown, the ground block 1010 includes a ground wire 1050 fixedly coupled with the ground block 1010 at a first connecting portion 1070 and a second connecting portion 1016. The first connecting portion 1070 may include a clamping member 1072. The clamping member 1072 may be part of a unitary monolithic structure (i.e., a single piece) with the first flat portion 1046 and/or the third flat portion 1048. For example, the clamping member 1072 may be defined by cutting, such as by laser cutting or any other metal cutting method, the first and/or third flat portions 1046, 1048 to delimit the clamping member 1072. The clamping member 1072 is then deformed to define an opening 1074 for receiving the ground wire 1050.

The second connecting portion 1016 may include a clamping member 1060. The clamping member 1060 may be part of a unitary monolithic structure (i.e., a single piece) with the second flat portion 1044 and/or the first flat portion 1046. For example, the clamping member 1060 may be defined by cutting, such as by laser cutting or any other metal cutting method, the second and/or first flat portions 1044, 1046 to delimit the clamping member 1060. The clamping member 1060 is then deformed to define an opening 1064 for receiving the ground wire 1050. The openings 1064, 1074 are configured to receive the ground wire 1050 on opposite sides of the first flat portion 1046, and the clamping members 1060, 1072 are configured to clamp the ground wire on opposite side of the first flat portion 1046

In use, the ground wire 1050 is disposed in the openings 1064, 1074. However, unlike the ground wire 650 described above, the ground wire extends from the clamping member 1072 around an end 1086 of the first flat portion 1046 that is distal to the second flat portion 1044, and then extends along the first flat portion 1046 to the clamping member 1060. After the ground wire 1050 is received by the openings 1064, 1074 defined by the clamping members 1060, 1072, the clamping members 1060, 1072 are deformed, such as crimping or the like, back toward their original configuration prior to being cut from the first, second, and/or third flat portions 1046, 1044, 1048 so as to clamp the ground wire 1050 between the clamping members 1060, 1072 and the first, second, and/or third flat portions 1046, 1044, 1048. Crimping of the clamping members 1060, 1072 reduces the size of the openings 1064, 1074 and may deform the ground wire 1050 into an S-shaped configuration such that the ground wire is configured to be non-detachable from the ground block 1010 during normal use of the ground block 1010. That is, the crimped S-shaped configuration of the ground wire 1050 prevents the ground wire 1050 from being slidably removed from the ground block 1010 during normal use of the ground block 1010. In particular, the ground block 1010 is designed to meet the physical requirements of UL testing, including the ability to maintain a ground connection between the ground wire 1050 and the ground block 1010 to transfer 3000 amps with up to 100 lbs. of force hanging from the ground wire 1050 at different angles.

Thus, the ground block 1010 does not require a seizure screw for securing the ground wire 1050 to the ground block 1010. Consequently, the ground block 1010 may not include the connection point 16 and seizure screw 18 described with respect to the conventional ground block shown in FIGS. 1 and 2. However, in some embodiments, the ground block 1010 may include a connection point 16 and a seizure screw 18 to reattach the ground wire 1050 to the ground block 1010 in the event that the ground wire 1050 becomes unintentionally detached from the ground block 1010 during abnormal use. It should be appreciate that in some embodiments, the crimped ground wire 1050 may be additionally attached to the ground block 1010 by soldering or brazing the wire directly to the ground block 1010.

As illustrated, the ground wire 1050 has a first end 1052 connected to the ground block 1010 at the first connection portion 1070 and a second portion 1058, spaced from the first end 1052, connected to the ground block 1010 at the second connection portion 1016. Similar to ground wire 150, a second end (not shown) of the ground wire 1050 may include a termination member, such as for example, a terminal lug (not shown) that is fixedly coupled with the second end of the ground wire 1050 by soldering, brazing, or mechanical bonding. In some aspects, the first flat portion 1046 may include a rounded end wall 1082 configured to limit the bend radius of the ground wire to a minimum radius in the event that a third portion 1084 of the ground wire 1050 between the second portion 1058 and the second end is wrapped around the first flat portion 1046 and directed back toward the third flat portion 1048.

The connection between the terminal lug and the ground wire 1050 is configured to be permanent during normal use of the ground block 1010. The ground wire 1050 has a length selected such that the terminal lug is attachable to a common bonding/ground point at the time of installation of the ground block 1010. For example, ground blocks 1010 according to the present disclosure may include ground wires 1050 with different incremental fixed lengths such as, for example, 5 feet, 10 feet, 25 feet, 50 feet, etc.

The ground block 1010 may include a plurality of mounting screws (not shown) that fit into holes 1034, 1038, respectively, in flat portions 1044, 1048, respectively, to mount the ground block 1010 to a wall or other structure during installation. Using a single monolithic blank of stainless steel provides a location for the ground wire 1050 to attach at the connecting portion 1016, which in turn is electrically connected through the first, second, and third flat portions 1046, 1044, 1048 to the connector body 112, thus minimizing the number of separate, discrete contacts between the ground wire 1050 and the metal connector body 112. The geometry of the ground block 1010 may be such that a weather seal or seals can be used to effectively seal the connection between connector body 112 and the first flat portion 1046. Forming the ground block 1010 from the stainless steel blank may be done by progressive die stamping, although laser cutting could be used.

Referring now to FIGS. 13-16, an exemplary bonding/ground block 410 in accordance with various aspects of the disclosure is shown. The ground block 410 may include a first flat portion 446, a second flat portion 444 preferably orthogonal to the first flat portion 446, and a third flat portion 448 preferably parallel to the second flat portion 444 and orthogonal to the first flat portion 446. The first, second, and third flat portions 446, 444, 448 may be cut and folded from a single monolithic piece of stainless steel, thus providing excellent electrical conductivity between the portions.

The ground block 410 includes a connector body 412, a ring terminal 460, and a dress ring 414. The connector body 412 may be any known or conventional connector body, for example, an F81 barrel connector having two threaded end portions 413*a*, 413*b* and a middle portion 415 between the end portions 413*a*, 413*b*. The middle portion 415 includes a flange 415' having an outer dimension that is greater than the outer diameter of the two threaded end portions 413*a*, 413*b* of the connector body 412. The ring terminal 460 is sized and arranged to slide over a first threaded end 413*a* and be fitted on the middle portion 415 adjacent the flange 415'.

A hole (not shown) within the first flat portion 446 is preferably dimensioned to receive the connector body 412, which is preferably of a material suitably corrosion resistant, such as brass, and configured to be press-fitted into the hole. The first threaded end 413*a* is inserted through the hole in a first direction until the ring terminal 460 is sandwiched between the flange 415' and the first flat portion 446. Thus, the flange 415' and ring terminal 460 limit an insertion distance of the connector body 412 into the hole 442. The middle portion 415 of the connector body 412 is press-fitted into the hole 442 with the ring terminal 460 sandwiched between the flange 415' and the first flat portion 446.

The dress ring 414 is slipped over the first end portion 413*a* in a second direction opposite to the first direction and is press-fitted onto the middle portion 415 of the connector body 412, thus forming a press-fit and stake connection between the connector body 412 and the first flat portion 446. In an embodiment where the connector body 412 is press-fitted to the first flat portion 446, it may be relatively easy to weather seal the connection because of the flat areas of the connector body 412 on either side of the first flat portion 446, i.e., because the connector body 412 is not screwed into the hole, there are no threads which need to be weather-sealed. The middle portion 415 of the connector body 412 and the first flat portion 446 may have a keyed connection to prevent relative rotation between the connector body 412 and the first flat portion 446. For example, the middle portion 415 may have a flattened region along is circumference and the hole of the first flat portion 446 may have a complementary flattened region.

A ground wire 450 is fixedly coupled with the ground block 410 at the ring terminal 460. For example, a connection portion 462 of the ring terminal 460 may be crimped onto the ground wire 450. In other aspects, the ground wire 450 may be attached to the ground block 410 by soldering or brazing the wire to the ring terminal 460. The ground wire 450 has a first end 452 connected to the ground block 410 at the connection portion 462. A second end (not shown) of the ground wire 450 may be a bare wire or may include a terminal lug (not shown) that is fixedly coupled with the second end of the ground wire 450 by soldering, brazing, or mechanical bonding. The connection between the terminal lug and the ground wire 450 is configured to be permanent during normal use of the ground block 410. Thus, the ground wire 450 would have a length selected such that the terminal lug is attachable to a common bonding/ground point at the time of installation of the ground block 410. For example, ground blocks 410 according to the present disclosure may include ground wires 450 with different incremental fixed lengths such as, for example, 5 feet, 10 feet, 25 feet, 50 feet, etc.

The ground block 410 may include a plurality of mounting screws (not shown) that fit into holes 434, 438, respectively, in flat portions 444, 448, respectively, to mount the ground block 410 to a wall or other structure during installation. The geometry of ground block 410 may be such that a weather seal or seals can be used to effectively seal the connection between connector body 412 and flat portion 446. Forming the ground block 410 from the stainless steel blank may be done by progressive die stamping, although laser cutting could be used.

Figure 17:
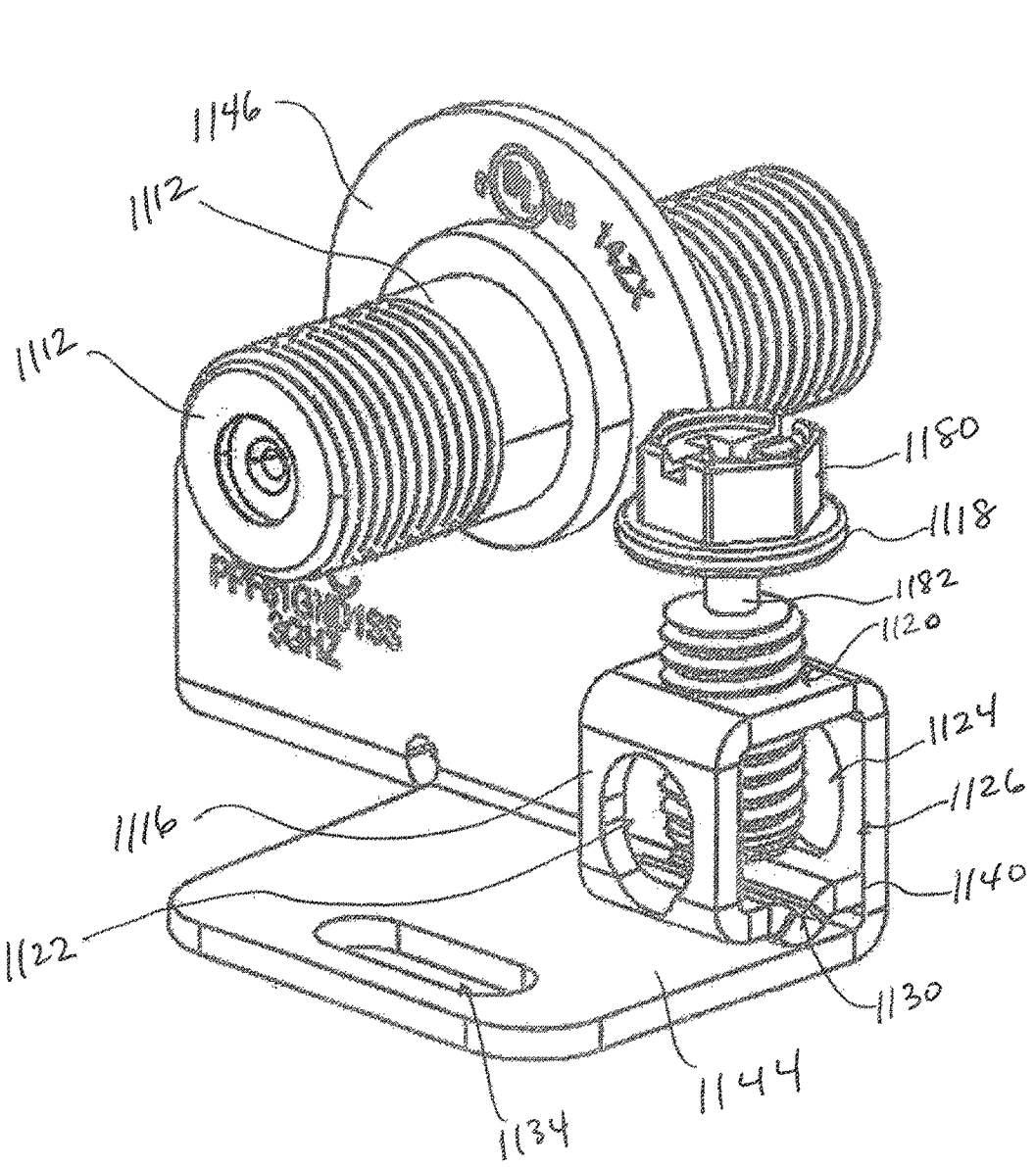
FIG. 17 shows a front perspective view of an exemplary bonding/ground block in accordance with various aspects of the disclosure.
Figure 18:
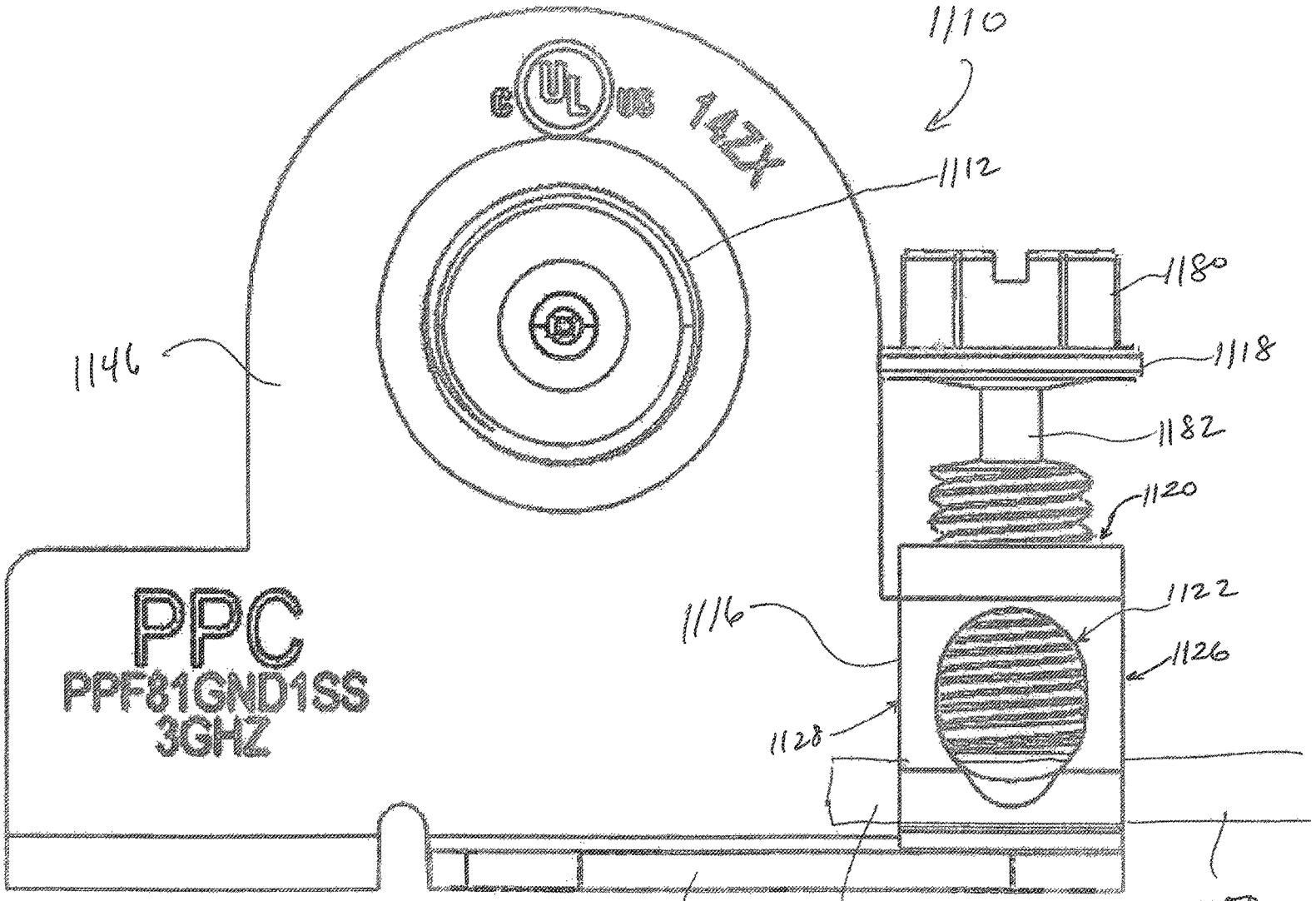
FIG. 18 shows a front view of the exemplary bonding/ground block of FIG. 17.
Figure 19:
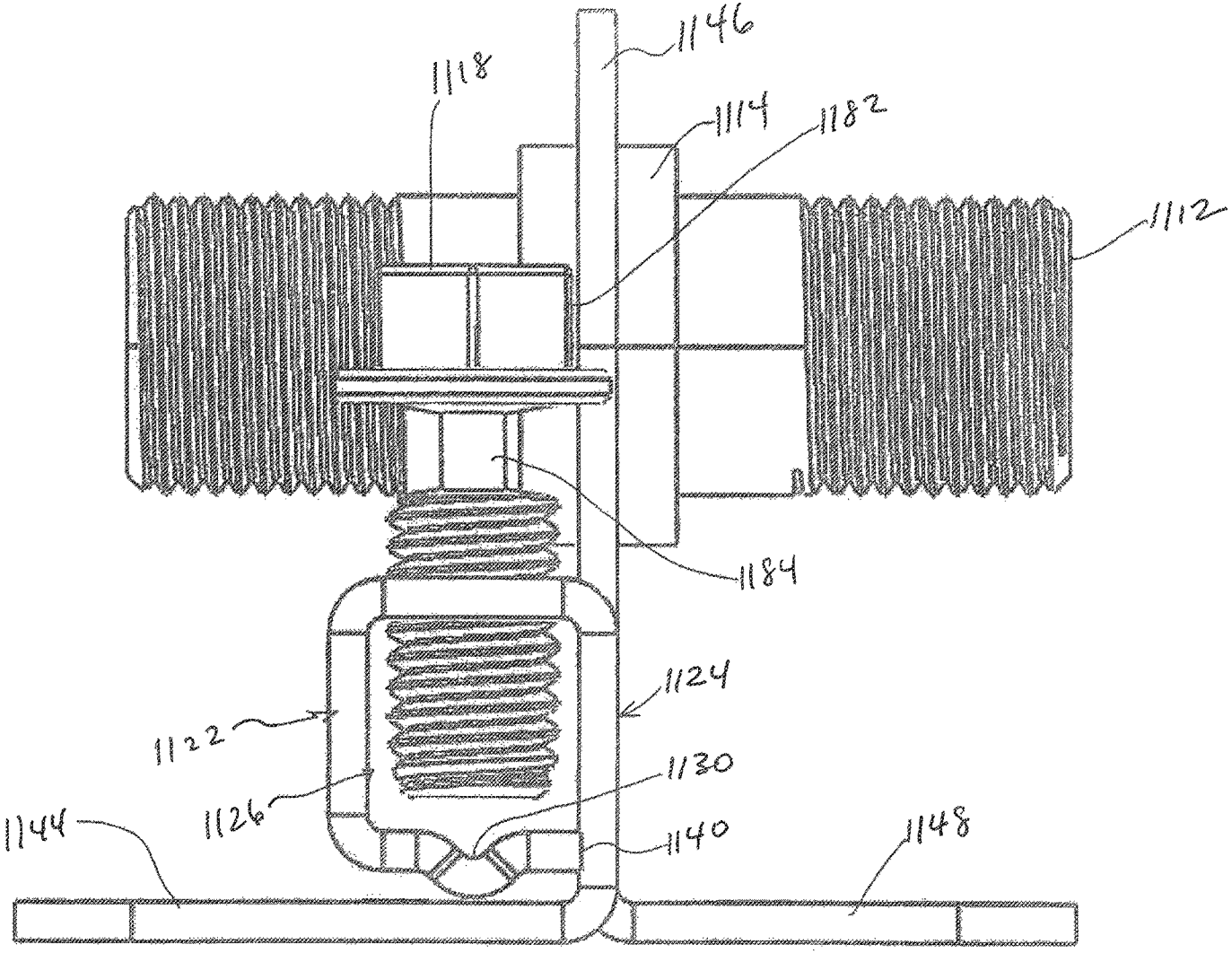
FIG. 19 shows a side view of the exemplary bonding/ground block of FIG. 17.

Referring now to FIGS. 17-19, an exemplary bonding/ground block 1110 in accordance with various aspects of the disclosure is shown. The ground block 1110 may include a first flat portion 1146, a second flat portion 1144 preferably orthogonal to the first flat portion 1146, and a third flat portion 1148 preferably parallel to the second flat portion 1144 and orthogonal to the first flat portion 1146. The first, second, and third flat portions 1146, 1144, 1148 may be cut and folded from a single monolithic piece of stainless steel, thus providing excellent electrical conductivity between the portions.

A hole (not shown) within the first flat portion 1146 is preferably dimensioned to receive a connector body 1112 which is preferably of a material suitably corrosion resistant, such as brass, and press-fitted into the hole. The connector body 1112 may be any known or conventional connector body, for example, an F81 barrel connector. After the connector body 1112 is press-fitted into the hole, a dress ring 1114 may be press-fitted from a first direction onto the connector body 1112 from a second direction opposite the first direction, thus forming a press-fit and stake connection between the connector body 1112 and the first flat portion 1146. In an embodiment where the connector body 1112 is press-fitted to the first flat portion 1146, it may be relatively easy to weather seal the connection because of the flat areas of the connector body 1112 on either side of the first flat portion 1146, i.e., because the connector body 1112 is not screwed into the hole, there are no threads which need to be weather-sealed.

The bonding block 1110 includes a connecting portion 1116. The connecting portion 1116 is preferably a one-piece folded metal frame with a hole 1120 for receiving a shear screw 1118 which, when screwed in, holds a ground wire (not shown) in place to effect a very low-resistance corrosion-resistant ground path from the ground wire through connecting portion 1116, second flat portion 1144, and first flat portion 1146 to connector body 1112. The shear screw 1118 is selected such that the when the shear screw 1118 is tightened to a desired torque, the head 1180 of the shear screw 1118 breaks away from the body 1182 of the shear screw. As a result, a technician will have a visual confirmation that the shear screw 1118 has tightened the ground wire 1150 to the bonding block 1110 at a desired specification. Also, the shear screw 1118 will not be removable from the connecting portion 1116 during normal operation of the bonding block 1110.

The connecting portion 1116 and the first, second, and third flat portions 1146, 1144, 1148 may comprise a single monolithic piece of an electrically conductive metal. Although the connecting portion 1116 includes a groove 1130 to help seize the ground wire when the ground wire is inserted through an aperture 1126 or an aperture 1128, the ground wire can also be inserted into connecting portion 1116 through an aperture 1122 or an aperture 1124. The connecting portion 1116 is preferably welded to the flat portion 1144 at a weld point 1140 to provide additional strength to the connection portion 1116. A plurality of mounting screws (not shown) fit into holes 1134, respectively, in flat portions 1144, 1148, respectively, to mount the bonding block 1110 to a wall or other structure during installation.

The ground wire 1150 has a first end 1152 connected to the ground block 1110 at the connection portion 1116 and a second end (not shown) that may be a bare wire or may include a terminal lug (not shown) that is fixedly coupled with the second end of the ground wire 1150 by soldering, brazing, or mechanical bonding. The connection between the terminal lug and the ground wire 1150 is configured to be permanent during normal use of the ground block 1110. The ground wire 1150 has a length selected such that the terminal lug is attachable to a common bonding/ground point at the time of installation of the ground block 1110. For example, ground blocks 1110 according to the present disclosure may include ground wires 1150 with different incremental fixed lengths such as, for example, 5 feet, 10 feet, 25 feet, 50 feet, etc.

Using a single monolithic blank of stainless steel provides a location for the ground wire 1150 to attach at the connecting portion 1116, which in turn is electrically connected through the first and second flat portions 1144, 1146 to the connector body 1112, thus minimizing the number of separate, discrete contacts between the ground wire 1150 and the metal connector body 1112. The geometry of ground block 1110 may be such that a weather seal or seals can be used to effectively seal the connection between connector body 1112 and flat portion 1146. Forming the ground block 1110 from the stainless steel blank may be done by progressive die stamping, although laser cutting could be used.

A method of manufacturing a ground block may include the steps of forming a ground block and clamping a ground wire to the ground block. In one embodiment, a method of manufacturing the ground block 310, 410, 610, 1010, 1110 may include the steps of (a) cutting a single monolithic piece of stainless steel to delineate a first flat portion, a second flat portion, and a third flat portion; (b) cutting a round hole into the first flat portion; (c) cutting an elongated hole into the second flat portion to accommodate a mounting screw; (d) cutting an elongated hole into the third flat portion to accommodate a mounting screw; (e) cutting one or more clamping members from the first flat portion and/or the second flat portion; (f) deforming the one or more clamping members to define openings configured to receive a ground wire; (g) bending the third flat portion backwards until the third flat portion is substantially orthogonal to the first flat portion; (h) bending the second flat portion forwards until the second flat portion is substantially orthogonal to the first flat portion; (i) inserting the ground wire into/through the openings; and (j) crimping the one or more clamping members to clamp the ground wire to the first flat portion and/or the second flat portion at a connection portion. It should be appreciated that the order of steps (a) through (j) may be modified according to preferred manufacturing processes.

Ground blocks 310, 410, 610, 1010, 1110 and the methods of making ground blocks according to the disclosure may provide a more secure method of attaching a ground wire 150, 350, 450, 650, 1050, 1150 to the ground block 310, 410, 610, 1010, 1110 and/or attaching the second end 154 of the ground wire 150, 350, 450, 650, 1050, 1150 to a bonding/ground point. Ground blocks 310, 410, 610, 1010, 1110 and methods of making ground blocks according to the disclosure also eliminate the need for a seizure screw and the possible loose connection associated therewith. As a result, ground blocks 310, 410, 610, 1010, 1110 and methods of making ground blocks according to the disclosure may provide a more secure permanent connection without the worry of loosening or high contact resistant wire attachment.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A ground block comprising:

a metal ground plate, the metal ground plate including
a first flat portion;
a second flat portion orthogonal to the first flat portion; and
a third flat portion parallel to the second flat portion and orthogonal to the first flat portion;

a ground wire fixedly coupled with the metal ground plate;

a first connecting portion where the ground wire is fixedly coupled with the metal ground plate; and a second connecting portion where the ground wire is fixedly coupled with the metal ground plate, wherein the first flat portion, the second flat portion, and the third flat portion comprise a single monolithic piece of an electrically conductive metal, wherein the first connecting portion includes a first clamping portion, the first clamping portion being a portion of the single monolithic piece of the electrically conductive metal that is cut from at least one of the first flat portion and the second flat portion wherein the second connecting portion includes a second clamping portion, the second clamping portion being a portion of the single monolithic piece of the electrically conductive metal that is cut from at least one of the first flat portion and the third flat portion, wherein the first clamping portion is configured to be deformed relative to the at least one of the first flat portion and the second flat portion from which the first clamping portion is cut so as to define a first opening between the clamping portion and the at least one of the first flat portion and the second flat portion from which the first clamping portion is cut, wherein the second clamping portion is configured to be deformed relative to the at least one of the first flat portion and the third flat portion from which the second clamping portion is cut so as to define an opening between the second clamping portion and the at least one of the first flat portion and the third flat portion from which the second clamping portion is cut, and wherein the first opening and the second opening are configured to receive the ground wire on opposite sides of the first flat portion.

2. The ground block of claim 1, wherein the first flat portion is configured to receive a connector body, the connector body being configured to couple two runs of coaxial cable.

3. The ground block of claim 1, further comprising a second connecting portion, the second connecting portion including a seizure screw assembly, wherein the seizure screw assembly is configured to electrically couple the ground wire to the metal ground plate in the event that the ground wire becomes unintentionally detached from the metal ground plate during abnormal use.

4. The ground block of claim 1, wherein the ground wire comprises a first end connected to the ground block at the connection portion and a second end, wherein the ground block further comprises a terminal lug fixedly coupled with the second end of the ground wire by soldering, brazing, or mechanical bonding, and wherein the terminal lug and the ground wire are configured to be permanently connected to one another during normal use of the ground block.

5. A ground block comprising:

a metal ground plate, the metal ground plate including
a first flat portion including a through hole;
a second flat portion orthogonal to the first flat portion; and
a third flat portion parallel to the second flat portion and orthogonal to the first flat portion;

a connector body received in the through hole of the first flat portion, the connector body having first and second threaded end portions and an unthreaded portion between the first and second threaded end portions, the connector body including a flange portion extending radially outward from the unthreaded portion;

a ring terminal surrounding the connector body and sandwiched between the flange portion and the first flat portion;

a dress ring fixedly mounted on the unthreaded portion on an opposite side of the first flat portion relative to the ring terminal and flange portion; and a ground wire fixedly coupled with the ring terminal;

wherein the first flat portion, the second flat portion, and the third flat portion comprise a single monolithic piece of an electrically conductive metal, wherein the clamped ground wire is configured to be non-detachable from the metal ground plate during normal use of the ground block.

6. The ground block of claim 5, wherein the connector body is configured to couple two runs of coaxial cable.

7. The ground block of claim 5, wherein the ground block further comprises a terminal lug fixedly coupled with a second end of the ground wire by soldering, brazing, or mechanical bonding, and wherein the terminal lug and the ground wire are configured to be permanently connected to one another during normal use of the ground block.

8. A ground block comprising:

a metal ground plate, the metal ground plate including
a first flat portion including a through hole;
a second flat portion orthogonal to the first flat portion; and
a third flat portion parallel to the second flat portion and orthogonal to the first flat portion;

a connector body received in the through hole of the first flat portion, the connector body having first and second threaded end portions and an unthreaded portion between the first and second threaded end portions, the connector body including a flange portion extending radially outward from the unthreaded portion;

a dress ring fixedly mounted on the unthreaded portion on an opposite side of the first flat portion relative to the ring terminal and flange portion;

a ground wire;

a connecting portion configured to fixedly couple the ground wire with the metal ground plate; and a shear screw configured to tighten the ground wire to the connecting portion at a desired torque, wherein the connecting portion includes a threaded opening configured to threadingly receive the shear screw, and the shear screw includes a head that is configured to break away from a body of the shear screw when the shear screw is tightened to a desired torque, thereby providing a visual confirmation that the shear screw has tightened the ground wire to the ground block at the desired torque and preventing the shear screw from being removed from the connecting portion during normal operation of the ground block, wherein the first flat portion, the second flat portion, and the third flat portion comprise a single monolithic piece of an electrically conductive metal, wherein the clamped ground wire is configured to be non-detachable from the metal ground plate during normal use of the ground block.

9. The ground block of claim 8, wherein the connector body is configured to couple two runs of coaxial cable.

10. The ground block of claim 8, wherein the ground block further comprises a terminal lug fixedly coupled with a second end of the ground wire by soldering, brazing, or mechanical bonding, and wherein the terminal lug and the ground wire are configured to be permanently connected to one another during normal use of the ground block.

* * * * *